US007903833B2

(12) United States Patent
Goldberg et al.

(10) Patent No.: US 7,903,833 B2
(45) Date of Patent: Mar. 8, 2011

(54) HEADWORN LISTENING DEVICE AND METHOD

(75) Inventors: Jack Goldberg, San Diego, CA (US); Randy L. Houk, San Diego, CA (US); Michael J Stern, Westlake Village, CA (US)

(73) Assignee: Hearing Enhancement Group, Thousand Oaks, CA (US)

( * ) Notice: Subject to any disclaimer, the term of this patent is extended or adjusted under 35 U.S.C. 154(b) by 217 days.

(21) Appl. No.: 11/682,837

(22) Filed: Mar. 6, 2007

(65) Prior Publication Data

US 2007/0223720 A1 Sep. 27, 2007

Related U.S. Application Data

(60) Provisional application No. 60/779,758, filed on Mar. 6, 2006.

(51) Int. Cl.
*H04R 25/00* (2006.01)

(52) U.S. Cl. ..... 381/329; 381/375; 381/376; 381/370; 381/374

(58) Field of Classification Search ..... 381/309, 381/367, 370, 375, 381, 376, 379, 71.6, 98, 381/322, 323, 312, 329, 104, 106; 379/428.02, 379/430

See application file for complete search history.

(56) References Cited

U.S. PATENT DOCUMENTS

| | | | | | |
|---|---|---|---|---|---|
| 4,629,834 | A * | 12/1986 | Waggoner et al. | ..... | 381/316 |
| 5,233,665 | A * | 8/1993 | Vaughn et al. | ..... | 381/97 |
| 5,457,751 | A * | 10/1995 | Such | ..... | 381/375 |
| 5,553,151 | A | 9/1996 | Goldberg | | |
| 5,764,778 | A * | 6/1998 | Zurek | ..... | 381/312 |
| 5,987,147 | A * | 11/1999 | Nishimoto | ..... | 381/375 |
| 6,130,950 | A * | 10/2000 | Martin | ..... | 381/312 |
| 6,278,786 | B1 | 8/2001 | McIntosh | | |
| 7,031,475 | B2 * | 4/2006 | Kuraoka et al. | ..... | 381/74 |
| 2001/0046304 | A1 * | 11/2001 | Rast | ..... | 381/74 |
| 2002/0003889 | A1 * | 1/2002 | Fischer | ..... | 381/370 |
| 2002/0194005 | A1 | 12/2002 | Lahr | | |
| 2007/0165875 | A1 * | 7/2007 | Rezvani et al. | ..... | 381/74 |

OTHER PUBLICATIONS

GP522 Controller Chip. Preliminary Data Sheet, Document No. 522-21-02. Gennum Corporation, Nov. 1999.

DYN-AURA Engineering Laboratories, Inc., "Elite Headphones—An Enhanced Listening Device, Model 30, instructions", 7 pages, San Diego, California.

Dyn-Aura Engineering Laboratories, Inc., "Elite Headphones - An Enhanced Listening Device, Model 30, instructions," 7 pages, Published in: San Diego, California, believed to be in the public domain at least as early as 2001. Applicant admits this reference to be prior art.

* cited by examiner

*Primary Examiner* — Vivian Chin
*Assistant Examiner* — Jason R Kurr
(74) *Attorney, Agent, or Firm* — Zarian Midgley & Johnson PLLC

(57) ABSTRACT

A headworn listening device includes a right ear assembly and a left ear assembly interconnected by a headband. The headworn listening device is preferably comfortable to wear and provides high-quality audio and flexible signal processing features without requiring customized fitting. The listening device includes a signal processor with programmable signal processing characteristics and a memory storing a plurality of user-selectable signal processing settings. For example, there may be signal processing settings for different environments, such as a first setting for a quiet environment and a second setting for a noisy environment. In operation, a user actuates a user-operable control coupled to a microcontroller to select a desired signal processing setting.

22 Claims, 18 Drawing Sheets

208
205
206
232
230
223
222
260
214
248
218
256
212
219

208
203
254
252
237
210

HEADWORN LISTENING DEVICE AND METHOD

CROSS-REFERENCE

This application claims priority to U.S. Provisional Patent Application No. 60/779,758, filed Mar. 6, 2006 and entitled SELF-TESTING HEARING SYSTEM AND METHOD. The application is also related to co-pending U.S. patent application Ser. No. 11/682,844, filed concurrently herewith and entitled SELF-TESTING PROGRAMMABLE LISTENING SYSTEM AND METHOD. The disclosures of these related applications are hereby incorporated by reference in their entireties.

BACKGROUND

The present invention relates to a device for processing sound or other sonic information with applicability in situations where there is difficulty perceiving that sound or information, for example, at times when it is difficult to understand speech. The device is self-contained and fits on the user's head similar to a headset.

There are many situations where an individual may wish to better perceive sound or other sonic information in his or her environment. A common situation which may occur is difficulty in understanding speech, due to, for example, interfering noise or limited hearing capabilities. Another situation in which there may be difficulty perceiving sonic information is during the evaluation of a vehicle design or while maintaining mechanical equipment. In these situations, a listener may wish to perceive sounds in a limited frequency range in order to diagnose problems or to more easily locate the source of a sound. Other applications may include elimination of noise during the operation of radio or telephony equipment, elimination of interfering sounds such as clicks and buzz while listening to speech or music, and the processing of either infrasonic or ultrasonic sound such that it can be heard within the frequency range of human hearing.

Of particular interest are situations in which there is difficulty in understanding speech. Generally, difficulty in understanding speech is due to the inability of a person to sense weak sounds or the person's inability to hear clearly in the presence of interfering noise. Many different signal processing schemes have been employed to assist in listening to speech. For example, U.S. Pat. No. 5,553,151 to Goldberg and U.S. Pat. No. 5,131,046 to Killion, et. al. are analog circuits for processing sound for assisting the hard of hearing. Digital sound processing technology is described, for example, in U.S. Pat. No. 6,937,738 to Armstrong, et al and U.S. Pat. No. 6,292,571 to Sjursen.

Hearing aids and other assistive listening devices are designed to ameliorate hearing loss. Present-day hearing aids are generally small devices which fit into the ear of the user. Some hearing aids are so small that they fit entirely in the ear canal and can barely be seen, and others are larger and comprise a case which rests behind the ear of the user and a custom-fitted earmold which fits into the user's ear canal.

Difficulties which are evident to users of modern hearing aids include discomfort because the aid may fit tightly in the ear in order to prevent feedback. Further, the ear canals of hearing aid users may change shape over time, requiring refitting. Another difficulty with modern hearing aids is the complexity of the fitting process itself. A hard of hearing person must first be tested to determine his or her hearing loss characteristics and also generally undergo an ear canal impression, necessary for determination of the outer shape of either the hearing aid itself or an earmold. The hearing aid then must be delivered to the user, which often involves mechanical modification of the portion which fits into the ear, as well as adjustment of the hearing aid's characteristics. The process is generally time-consuming and expensive.

SUMMARY

The above-mentioned drawbacks associated with existing systems are addressed by embodiments of the present application, which will be understood by reading and studying the following specification.

The present application describes a headworn listening device which may assist with a variety of listening requirements. The headworn listening device is preferably comfortable to wear and provides high-quality audio and flexible signal processing features without requiring customized fitting.

In one embodiment, a headworn listening device comprises an input transducer configured to receive acoustic input signals and a signal processor operatively connected to the input transducer and having programmable signal processing characteristics. The listening device further comprises a right ear assembly in communication with the signal processor and having a first output transducer configured to generate audio output signals, a left ear assembly in communication with the right ear assembly and having a second output transducer configured to generate audio output signals, and a headband interconnecting the right ear assembly and the left ear assembly. The listening device further comprises a memory configured to store a plurality of user-selectable signal processing settings, a user-operable control configured to enable a user to select a desired signal processing setting, and a microcontroller operatively connected to the signal processor, the memory and the user-operable control, the microcontroller being configured to select a signal processing setting based on an input received via the user-operable control.

In another embodiment, a method is provided for operating a headworn listening device comprising a right earphone and a left earphone interconnected by a headband. The method comprises placing the right earphone on or in a user's right ear, placing the left earphone on or in the user's left ear, the left earphone in communication with the right earphone via the headband, and adjusting the performance of the headworn listening device by actuating a user-operable control coupled to a microcontroller to select a signal processing setting from among a plurality of such settings stored in memory.

In another embodiment, a headworn listening device comprises means for receiving acoustic input signals and means for processing the received acoustic input signals. The listening device further comprises a right ear assembly and a left ear assembly interconnected by a headband, each ear assembly having an output transducer configured to generate audio output signals based on the processed acoustic input signals, and means for configuring the processing characteristics of the headworn listening device by selecting from among a plurality of predetermined processing settings stored in a memory under the control of a microcontroller in communication with at least one user-operable control.

These and other embodiments of the present application will be discussed more fully in the detailed description. The features, functions, and advantages can be achieved independently in various embodiments of the present application, or may be combined in yet other embodiments.

DETAILED DESCRIPTION

In the following detailed description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that various changes may be made without departing from the spirit and scope of the present invention. The following detailed description is, therefore, not to be taken in a limiting sense.

This application relates to a headworn device for processing sound or other sonic information with applicability in situations where there is difficulty perceiving that sound or information. The device is comfortable to wear and easy to adjust and use. Several exemplary embodiments will be described to illustrate various features and advantages of the device.

Figure 1:
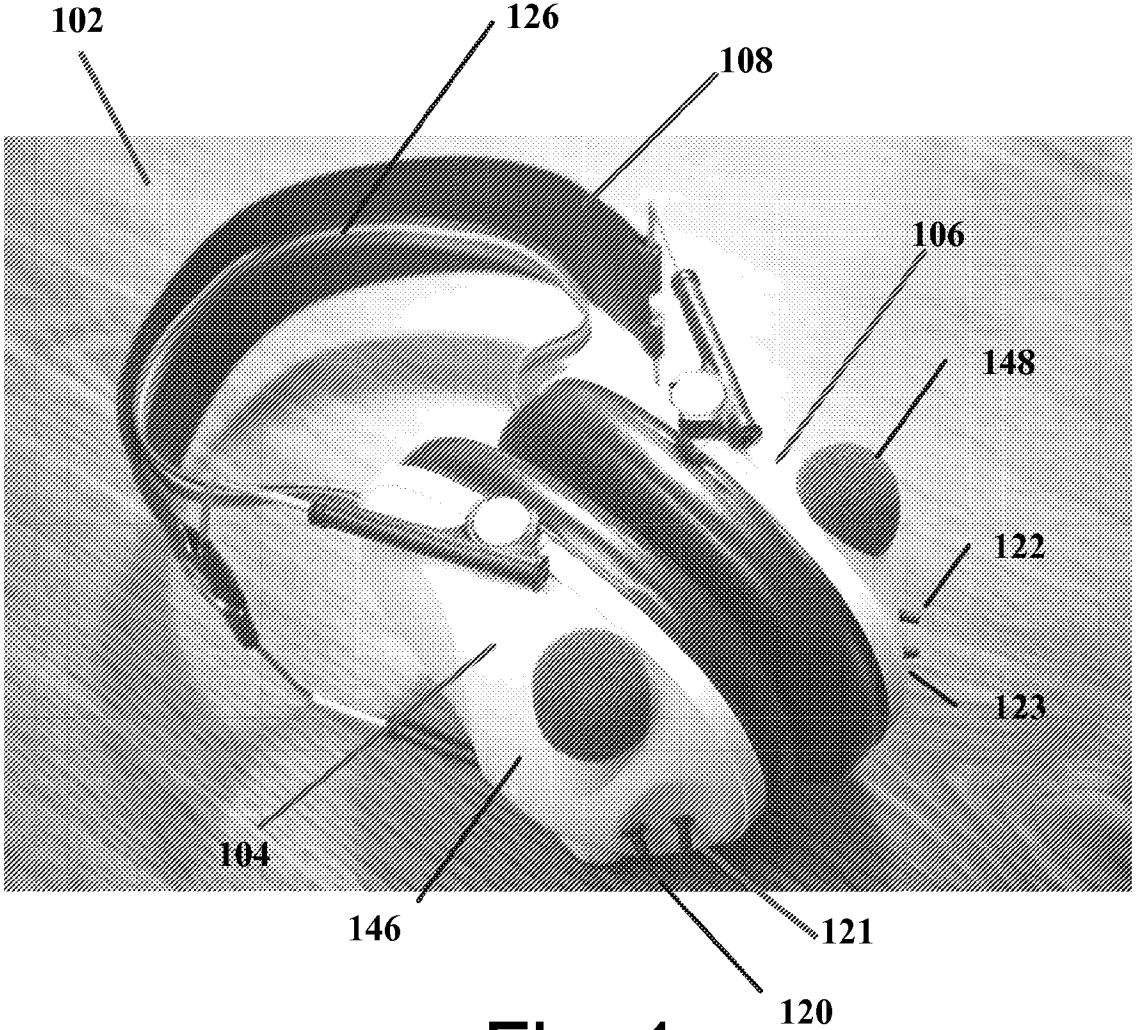
FIG. 1 is an external view of an embodiment illustrating microphones and volume controls.
Figure 2:
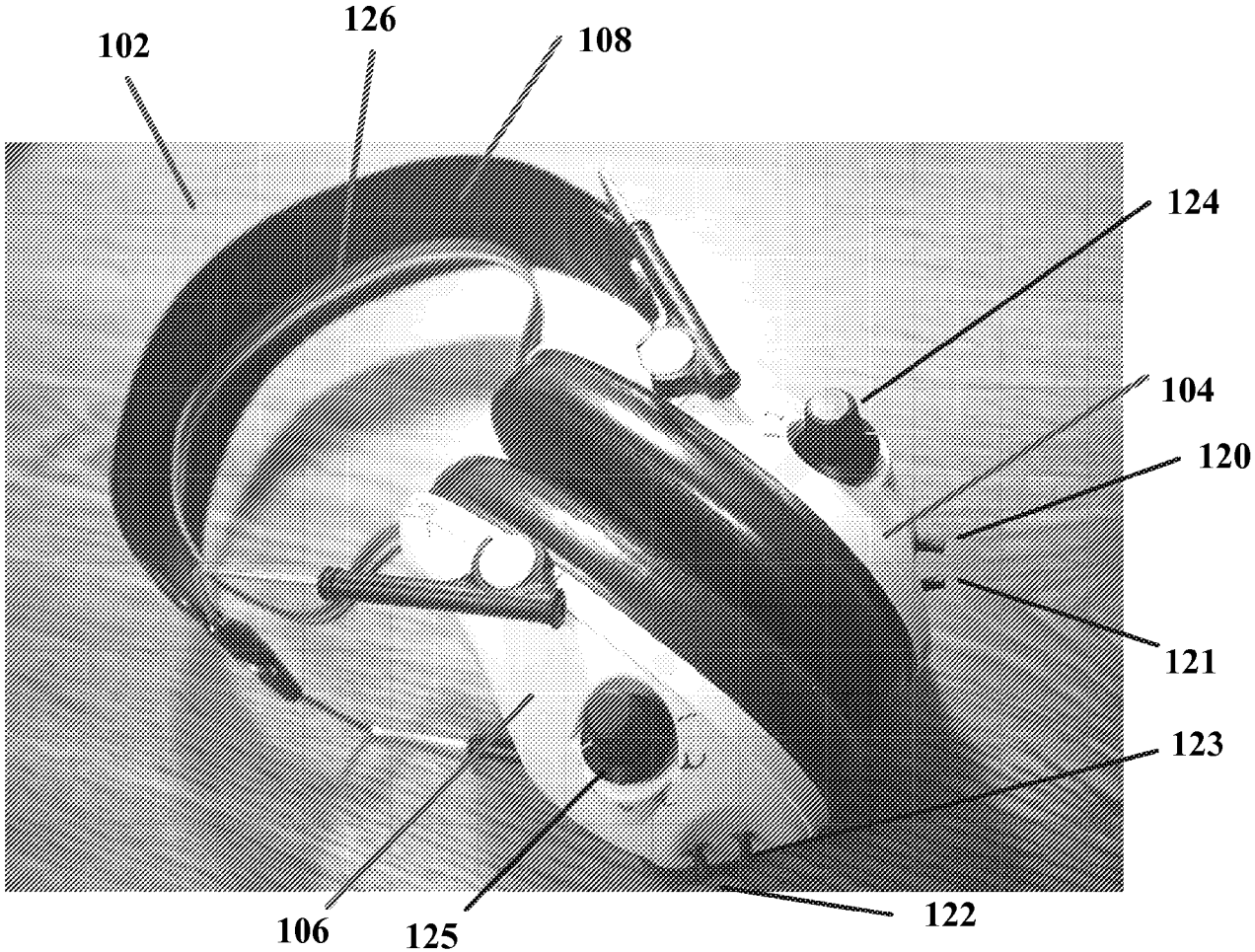
FIG. 2 is an external view of an embodiment illustrating user controls.

Shown in FIGS. 1 and 2 is a headworn listening device 102. FIG. 1 is a forward facing view and FIG. 2 is a rearward facing view. In the illustrated embodiment, the listening device 102 comprises a right-side assembly 104, a left-side assembly 106, a headband 108, user controls 120 thru 125, transducer assemblies 146 and 148, and interconnecting wires 126. Listening device 102 further comprises a microcontroller and at least one signal processor, as described in more detail below. In operation, the microcontroller controls the signal processing, and the result is a listening device 102 which may process sound in a way to ameliorate hearing difficulties.

As illustrated in FIGS. 1 and 2, up and down volume pushbuttons 122 and 123, respectively, are provided for control of the left side and up and down volume pushbuttons 120 and 121 are provided for control of the right side. Also provided are selector switches 124 and 125 which allow the user to select a variety of processing characteristics.

Figure 3:
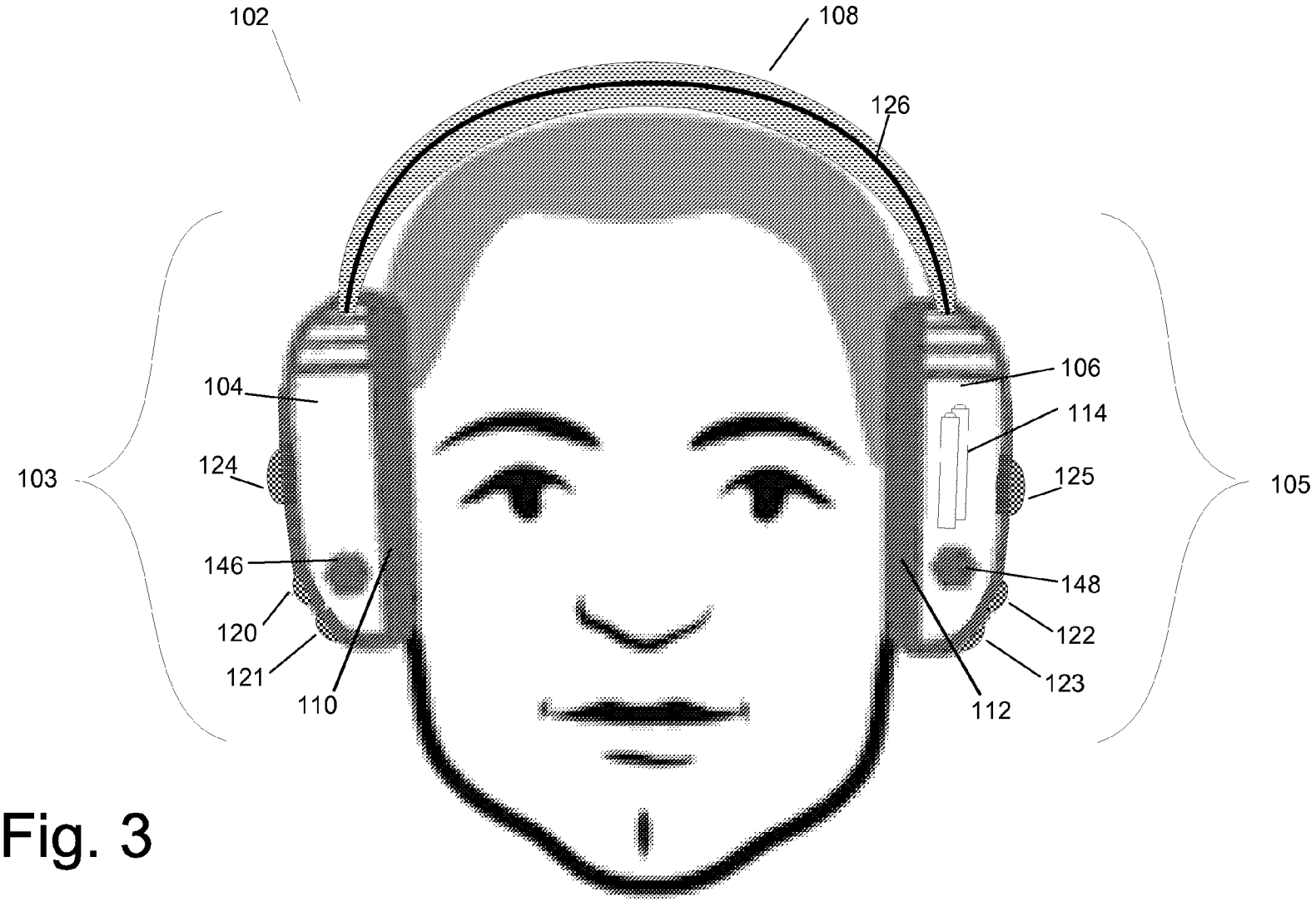
FIG. 3 is a view of an embodiment in place on a user's head.

FIG. 3 is a view of an embodiment of the listening device 102 in place on a user's head. The listening device 102 comprises a right side 103, a left side 105 and a headband 108. The right side 103 comprises right-side assembly 104, right input transducer assembly 146, right ear cushion 110, and right-side user controls 120, 121 and 124, as well as the right speaker and right circuit board and other items not shown in the figure. The left side 105 comprises left-side assembly 106, left input transducer assembly 148, left ear cushion 112 and left-side user controls 122, 123 and 125, as well as the left speaker and other items not shown in the figure.

In the illustrated embodiment, batteries 114 are housed in the left side 105 of the listening device 102. Pushbuttons 120 and 121 may adjust right volume up and right volume down, respectively. Pushbuttons 122 and 123 may adjust left volume up and left volume down, respectively. Alternatively, pushbuttons 120, 121, 122 and 123 may adjust volume and balance. Selector switches 124 and 125 can be used to select one of a plurality of signal processing settings. Right input transducer assembly 146 comprises at least one input transducer, an input transducer mount, and an input transducer cover which protects the input transducer(s) inside from moisture and dirt while allowing sound to pass through without significant attenuation. Similarly, left input transducer assembly 148 comprises at least one input transducer, an input transducer mount and an input transducer cover. Interconnecting wires 126 connect signal and control lines between right 103 and left 105 sides of the headset.

In the illustrated embodiment, the headband 108 is intended to be worn on a user's head. In other embodiments, the headband 108 may wrap behind the user's neck, hang under the user's chin, or may be configured in a variety of other suitable ways to keep the earphones in place on or in the user's ears. Alternatively, the right earphone and left earphone may function independently, or they may communicate with each other using a wireless communication link, such as a Bluetooth connection.

The earphones shown in FIG. 3 are of the circumaural type, meaning that the user's ears fit comfortably within the right ear cushion 110 and left ear cushion 112, respectively, when the listening device 102 is in use. The ear cushions 110 and 112 may be foam-filled or liquid-filled and covered with a resilient material, preferably providing an acoustic seal sufficient to prevent feedback. In other embodiments, the listening device 102 may take on a wide variety of other suitable configurations, such as, for example, earbuds, supra-aural earphones, canalphones, in-ear monitors, etc.

Housed within right- and left-side assemblies 104 and 106 are various electronic components including at least one signal processor. For applications involving the processing of sound in the range of human hearing, the input transducers which are part of assemblies 146 and 148 may be microphones. For applications involving the processing of infrasonic information, assemblies 146 and 148 comprise specialized infrasonic microphones or transducers, and for applications involving the processing of ultrasonic information, assemblies 146 and 148 comprise specialized ultrasonic microphones or transducers.

In operation, the signal processor(s) process the signals from the input transducers enabling the user to perceive sound or sonic information detected by the input transducers. If that sound or sonic information encompasses a frequency range beyond that of human hearing, the signal processor(s) comprise a frequency translation or information coding scheme to allow the user to hear the desired sound or sonic information. An example of a suitable frequency translation circuit is described in U.S. Pat. No. 5,289,505, entitled "Frequency translation circuit and method of translating," by Durec.

Figure 4:
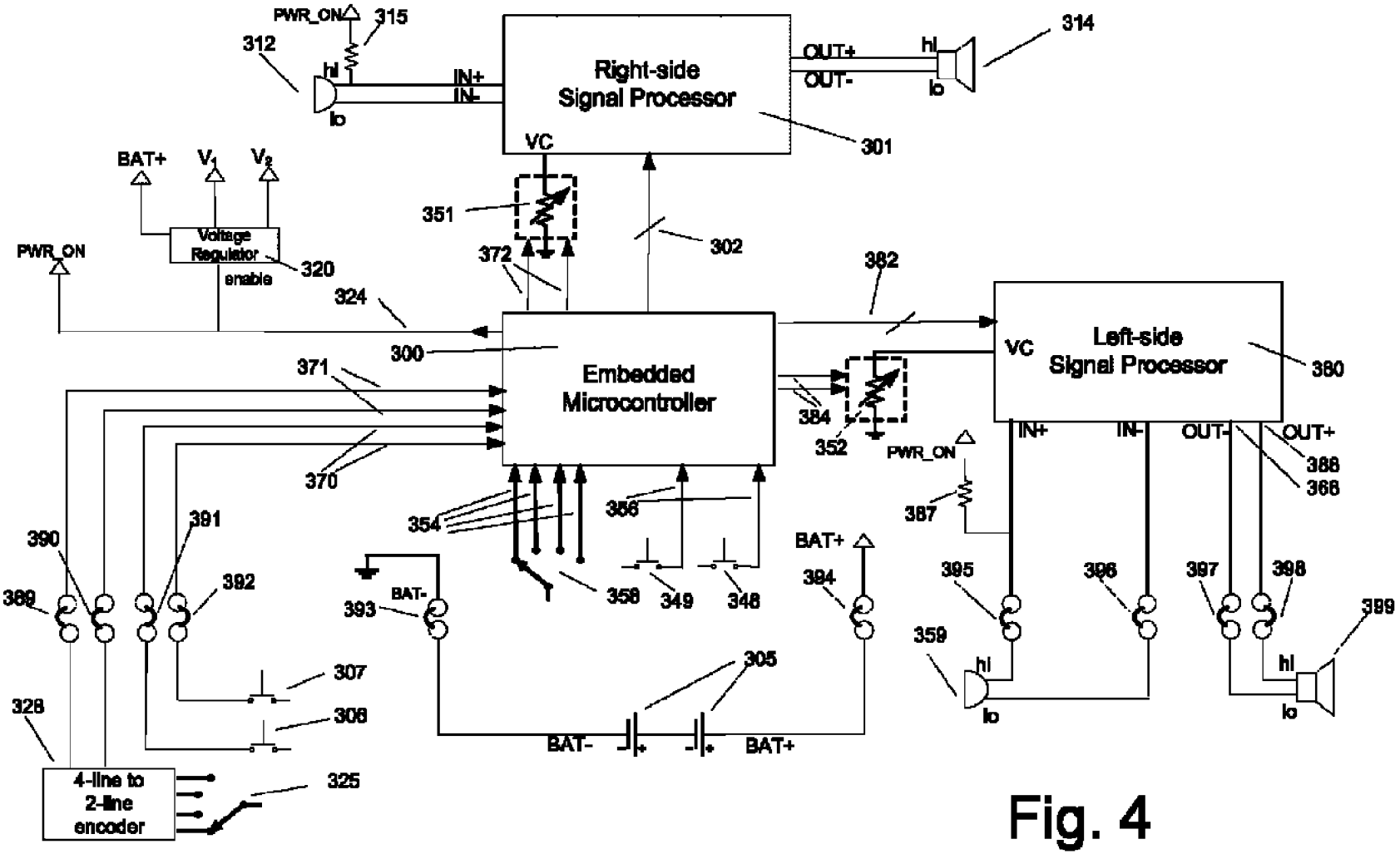
FIG. 4 is a block diagram of an embodiment.

A block diagram of one embodiment of the electronic circuitry in the listening device 102 is shown in FIG. 4. Ten wires interconnect the right and left sides of the device 102. In this example, the left side 105 of the listening device 102 comprises a small number of electronic components: LEFT UP and LEFT DOWN pushbuttons 306 and 307 respectively, batteries 305, left speaker 399, and left microphone 359. The ten interconnecting wires are labeled 389 through 398. The table below lists the function of each interconnect terminal pair.

TABLE 1

| interconnect | Function |
|---|---|
| 389 | left selector switch bit 0 |
| 390 | left selector switch bit 1 |
| 391 | left up volume pushbutton |
| 392 | left down volume pushbutton |
| 393 | battery negative |
| 394 | battery positive |
| 395 | left microphone high |
| 396 | left microphone low |
| 397 | left speaker low |
| 398 | left speaker high |

With reference to FIG. 4, this embodiment utilizes signal processors 301 and 380, which may comprise, for example, the model GB3215 supplied by Gennum Corporation, Burlington, Ontario, Canada, and its operation is described in available Gennum literature, such as "GB3215/GB3225 PARAGON™ Digital 4 Channel DSP System with FRONTWAVE™". The right side electronics of the headset comprises an embedded microcontroller 300 which is powered via the battery negative and battery positive connections, BAT− and BAT+. Batteries 305, for example two AAA batteries connected in series, are located in the left side 105 of the listening device 102. Embedded microcontroller 300 preferably comprises program memory, non-volatile data memory, digital input/output lines, timing and counting elements, and integrated oscillator to supply the clock signal for microcontroller operation. An example of a microcontroller suitable for this embodiment is the PIC16F913 supplied by Microchip Technology Inc., Chandler, Ariz. Right- and left-side signal processors may be identical.

Right side user controls 348, 349 and 358 connect directly to microcontroller 300 inputs via lines 354 and 356. Pushbutton 349 may provide the right-side volume up function and pushbutton 348 may provide the right-side volume down function. Right-side selector switch 358 may provide various setting selection functions. Left-side user pushbuttons 306 and 307 connect to microcontroller inputs via lines 370 and may provide the left-side volume up and volume down functions. Left-side selector switch 325, which is shown as a 4-position switch in FIG. 4, is connected to a 4-line to 2-line encoder 328. Encoder 328 reduces the number of required left to right interconnections and the outputs of encoder 328 connect to microcontroller inputs via lines 371. Left-side selector switch 325 may provide additional setting selection functions.

Microcontroller 300 controls the processing characteristics of right side signal processor 301 via output lines 302 and controls the processing characteristics of left-side signal processor 380 via output lines 382. Signal processors 301 and 380 both comprise VC (volume control) connections and volume may be controlled by providing a variable resistance attached to the VC connection. In order for microcontroller 300 to control right-side volume, output lines 372 connect to digital volume control 351. Similarly, in order to control left-side volume, microcontroller output lines 384 connect to digital volume control 352. Volume controls 351 and 352 may be, for example, the model MCP4011E supplied by Microchip Technology Inc., Chandler, Ariz. Control inputs to volume controls 351 and 352 allow the volume to be adjusted up or down electronically.

A source of power for signal processors 301 and 380 and for other components within the embodiment illustrated in FIG. 4 is voltage regulator 320 which may comprise, for example, the LT1761ES5-SD supplied by Linear Technology Corporation, Milpitas, Calif. Voltage regulator 320 is connected to both the positive and negative terminals of the battery, labeled BAT+ and BAT−, respectively, and regulator 320 generates output voltages $V_1$ and $V_2$. Regulator 320 comprises an enable input which connects to microcontroller output line 324, labeled as PWR_ON. When line 324 is high, voltage regulator 320 supplies its output voltages.

In the embodiment of FIG. 4, right-side signal processor 301 is connected to microphone 312 and left-side signal processor 380 is connected to microphone 359. Right-side signal processor 301 is connected to right speaker 314 and left digital signal processor is connected to left speaker 399. At its output terminals, labeled OUT+ and OUT−, right-side signal processor 301 is connected to speaker 314. Left-side signal processor 380 is connected to speaker 399. Speakers 314 and 399 may be 32 ohm headphone speakers having a diameter of 50 millimeters, for example.

In some embodiments, microphones 312 and 359 may be omnidirectional two-terminal electret microphones having a diameter of 6 millimeters. The high and low terminals of right microphone 312 are connected to the IN1+ and IN− pins of signal processor 301. The high terminal of right microphone 312 is also connected to a power source via resistor 315. Similarly the high and low terminals of left microphone 359 are connected to signal processor 380 and the high terminal is also connected to a power source via resistor 387. In the illustrated embodiment, microphone power is supplied by the PWR_ON microcontroller output signal 324, and resistors 315 and 387 are each 3.3K ohms. This PWR_ON signal is also wired to the enable input of voltage regulator 320, as discussed above. Thus when PWR_ON is set low, no power is supplied to either of the microphones, to either signal processor, or to any other circuitry outside microcontroller 300. Further, microcontroller 300, which is always connected to the battery voltage BAT+, may be set to an extremely low power "sleep" state under firmware control. Consequently, when PWR_ON is set low, a low amount of current is drawn from the batteries.

Figures 5A, 5B:
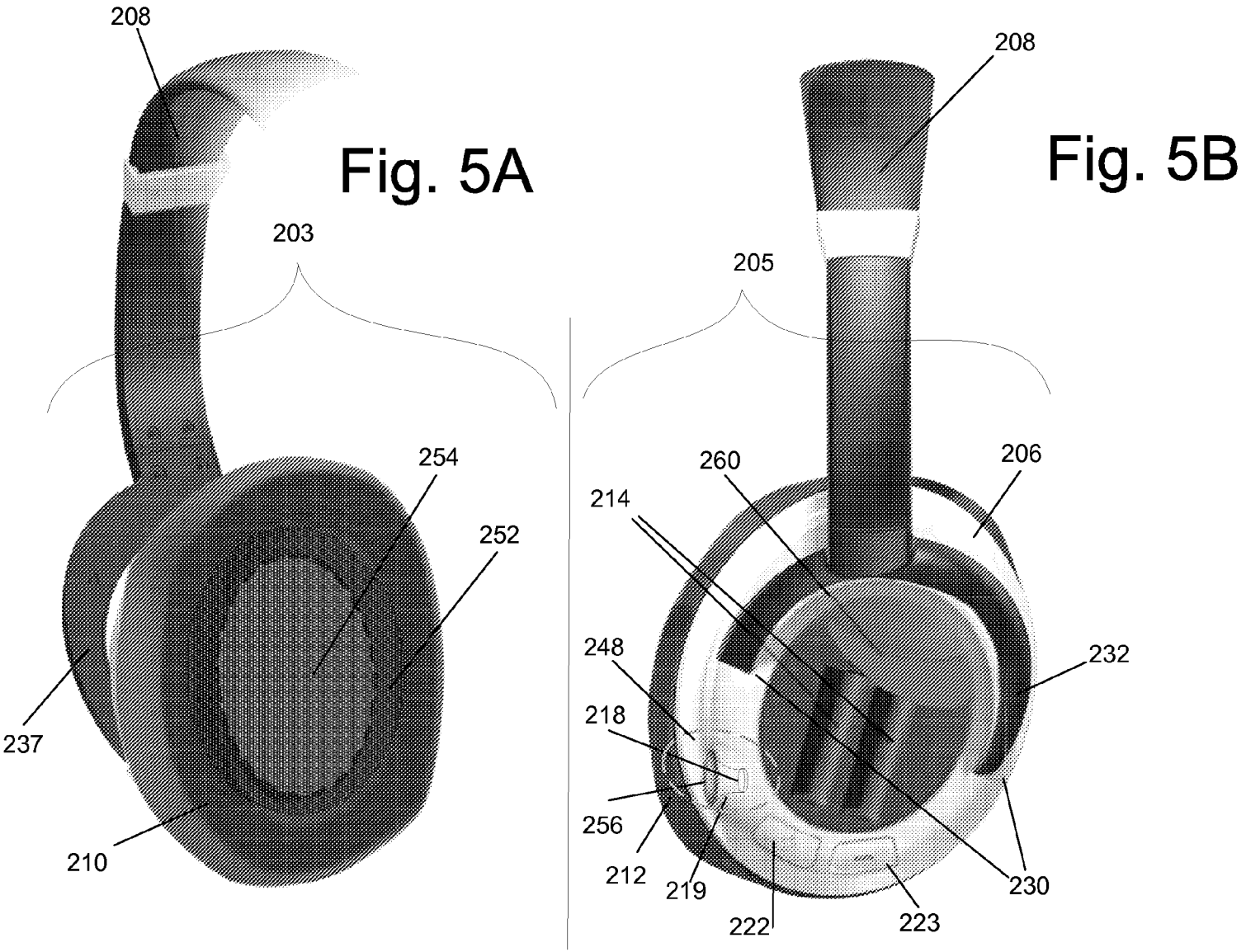
FIG. 5A is an external view of the right side of an alternative embodiment illustrating the ear cushion and speaker.
FIG. 5B is a view of the left side of an alternative embodiment illustrating external features.
Figure 5C:
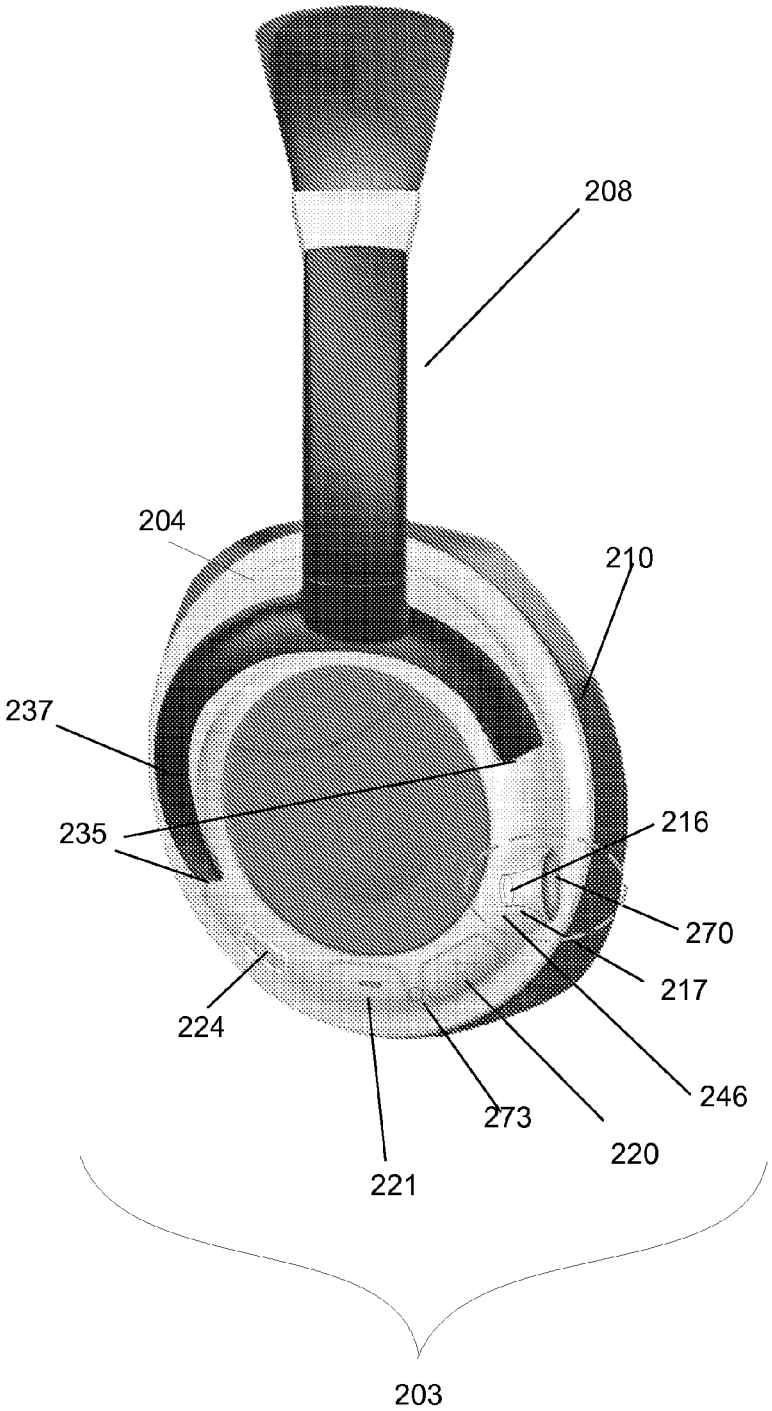
FIG. 5C is a view of the right side of an alternative embodiment illustrating external features.

FIGS. 5A, 5B and 5C are external views of an alternative embodiment illustrating in more detail the features of the listening device 102. FIG. 5A is an external view of the right side 203 of the listening device 102, illustrating the right ear cushion 210 and right output transducer (speaker) 254 which is located behind right speaker cover 252. Right speaker cover 252 is preferably made of a material which protects the underlying speaker while allowing sound to pass through without significant attenuation. A similar arrangement exists related to the left speaker and left speaker cover.

FIG. 5B is a view of the left side 205 of an alternative embodiment of listening device 102 illustrating external features. As shown, the left side 205 of the listening device 102 comprises left ear assembly 206, batteries 214, battery cover 260, left input transducer assembly 248, left ear cushion 212 and left-side pushbuttons 222 and 223, as well as the left speaker and other items not shown in the figure. Left ear cushion 212 is preferably compliant and provides an acoustic seal sufficient to prevent feedback.

Left input transducer assembly 248 comprises left input transducer 218, which is mounted into left input transducer holder 219, a trumpet-shaped piece made of a rubbery material such as Buna-N, and left input transducer cover 256. The trumpet-like shape of input transducer mount 219 enhances directional response for input transducer 218, which may be an omnidirectional type. Left input transducer cover 256 protects the left input transducer from moisture and dirt while allowing sound to pass through without significant attenuation. When battery cover 260 is opened, as shown in the figure, batteries 214 are revealed and can easily be replaced. The headband 208 attaches to the left ear assembly 206 at pivot points 230 where the left yoke portion of headband 208 physically attaches to left ear assembly 206.

FIG. 5C is a view of the right side 203 of an alternative embodiment of listening device 102 illustrating external features. As shown, the right side 203 comprises right ear assembly 204, right input transducer assembly 246, right ear cushion 210, right-side pushbuttons 224, 220 and 221, and LED 273, as well as the right speaker and other items not shown in the figure. Right ear cushion 210 is preferably compliant and provides an acoustic seal sufficient to prevent feedback. Right input transducer assembly 246 comprises right input transducer 216, which is mounted into right input transducer holder 217, which is similar to left input transducer holder 219, and right input transducer cover 270.

With reference to FIGS. 5B and 5C, interconnecting wires 226 (illustrated in FIG. 3) are routed out of left ear assembly 206 at one of the pivot points 230, through the left yoke portion 232, through the headband 208, through the right yoke portion 237 and into the right ear assembly 204 at one of the pivot points 235. In some embodiments, when the listening device 102 is turned on, light emitting diode (LED) 273 will glow and also may be used for other indications.

Although FIGS. 5A, 5B and 5C illustrate an embodiment which comprises an integral transducer, such as a microphone, embodiments may alternatively comprise a remote input transducer or a link, either wired or wireless, to a transducer or audio signal source within an external device. Examples of wireless links which may be utilized include a Bluetooth interface, which may accommodate external devices such as cell phones, or a radio frequency link which may be used in a classroom situation, or an infrared link. Embodiments which receive input signals via a wireless link comprise suitable circuitry for receiving the linked signal, such as a Bluetooth receiver or infrared receiver.

In some embodiments, an external programming module may provide an input signal to the listening device 102 via a wireless link or a wired link, to provide information to the listening device 102 which configures its signal processing characteristics. The capability of the listening device 102 to receive both acoustic input signals as well as information for configuring signal processing characteristics from an external programming module can be used to assist a user of the listening device 102 to configure it for most effective operation. For example, the external programming module may provide test prompts (e.g., test stimuli, instructions, etc.) to the user via the listening device 102, evaluate the user's responses to the test prompts, and then configure the signal processing characteristics of the listening device 102 accordingly.

Figure 6:
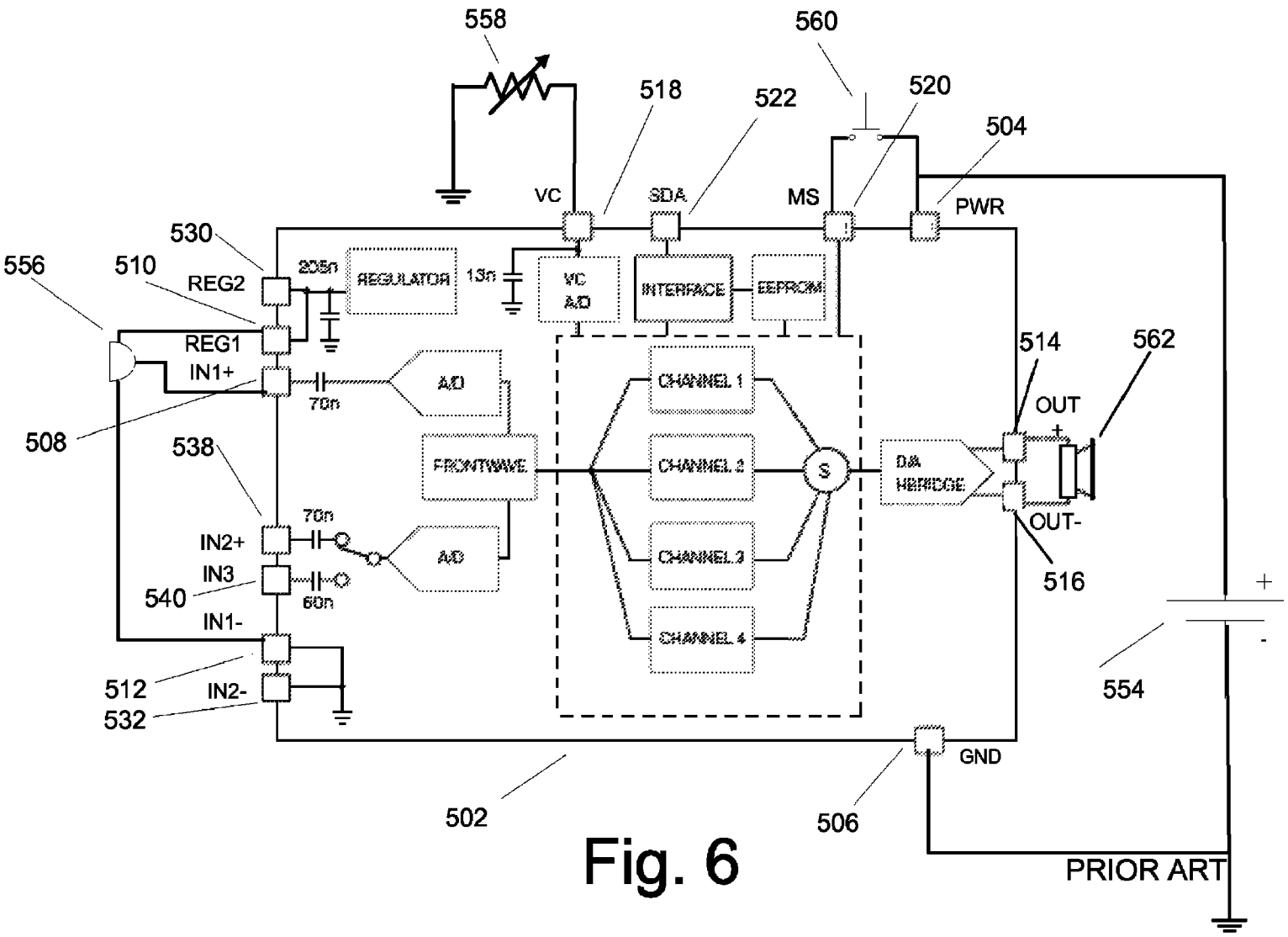
FIG. 6 is a prior art block diagram of an aid for listening

A block diagram of a listening device comprising a digital circuit for processing sound is shown in FIG. 6 (prior art). In this example, digital signal processor 502 is the Gennum model GB3215. This signal processor 502 is packaged as a small integrated circuit which may be connected as shown in FIG. 2. IN1+ terminal 508, IN1− terminal 512, and regulated voltage terminal REG1 510, are connected to three-terminal microphone 556. OUT+ terminal 514 and OUT− terminal 516 are connected to receiver 562. The positive connection of a battery 554, for example a type commonly used in hearing instruments, is wired to PWR terminal 504 and the negative connection is wired to GND terminal 506. Volume control 558 is connected between the VC terminal 518 and ground. Other features of digital signal processor 502 include 1) the ability to utilize a second microphone which may be connected at terminals 538 (IN2+), 532 (IN2−), and 530 (REG2), 2) the availability of a third input terminal 540 (IN3) for connection to an alternate signal source, and 3) the availability of a MODE pushbutton switch 560 connected between terminal 520 (MS) and the PWR terminal 504. When a second microphone is utilized and the two microphones are located as recommended by the manufacturer, digital signal processor 502 may be configured to provide a more directional response than that which can be attained with a single microphone. Configuration of digital sound processor 502 may be carried out by the transfer of data at serial data (SDA) terminal 522.

Figure 7A:
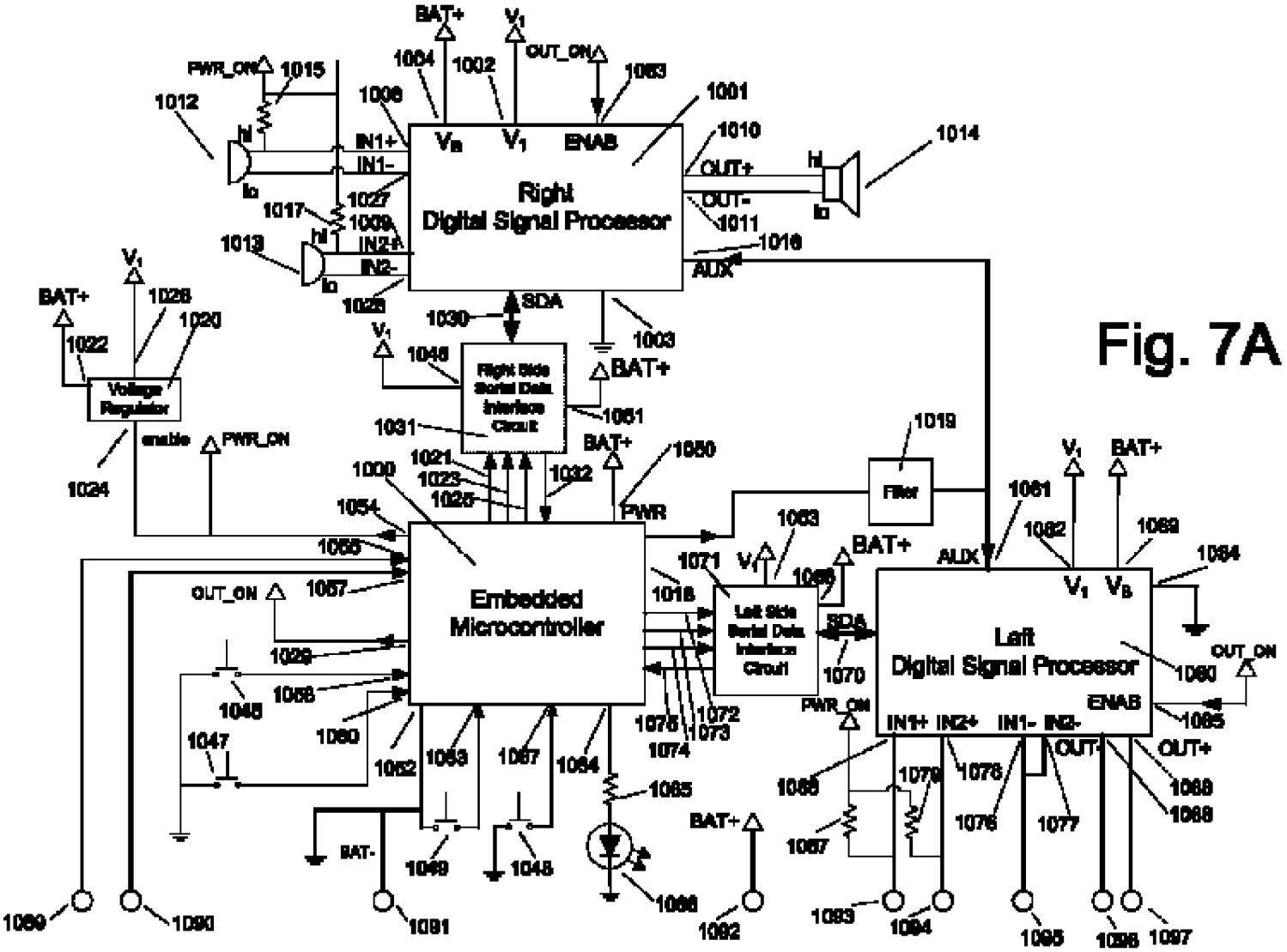
FIG. 7A is a block diagram of the right side circuitry in an alternative embodiment.
Figure 7B:
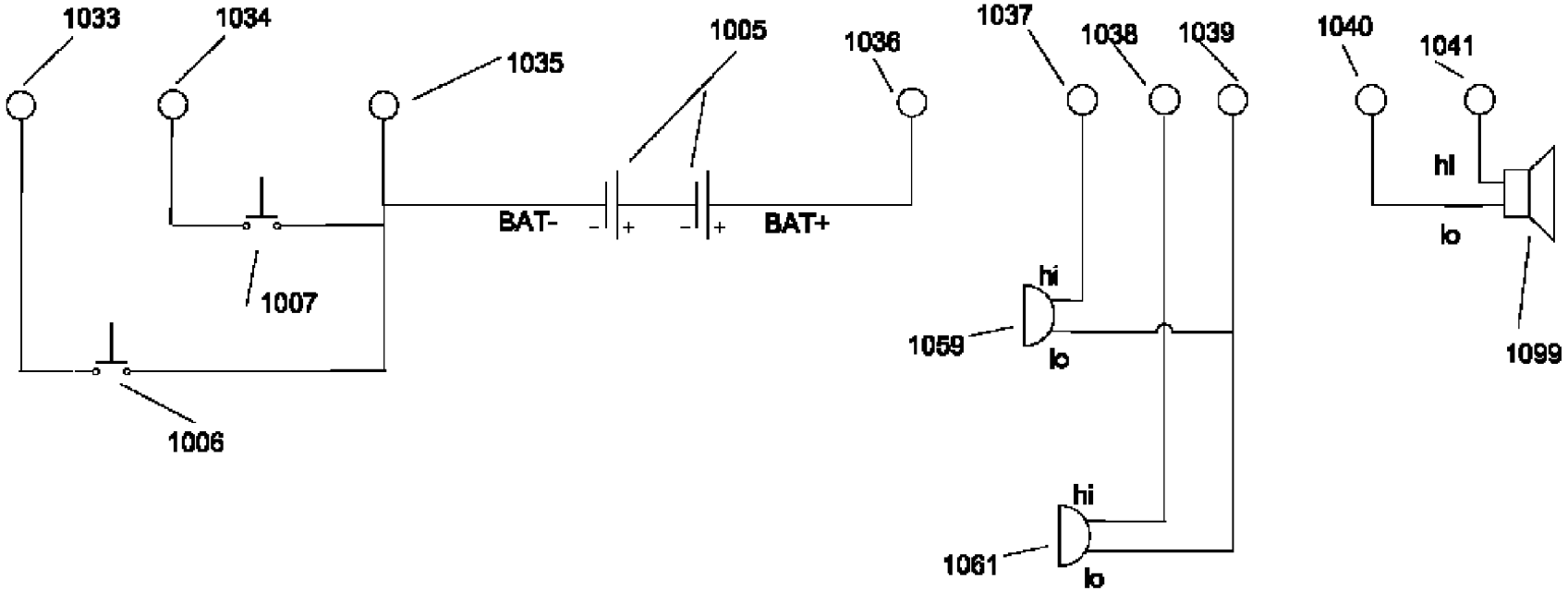
FIG. 7B is a block diagram of the left side circuitry in an alternative embodiment.

A block diagram of the electronic circuitry in an embodiment of listening device 102 comprising digital signal processing is shown in FIGS. 7A and 7B, with FIG. 7A illustrating the right side 103 and FIG. 7B illustrating the left side 105. Nine wires interconnect the right and left sides 103, 105 of the listening device 102. In this example, the left side 105 of the listening device 102 contains a small number of electronic components: LEFT UP and LEFT DOWN pushbuttons 1006 and 1007 respectively, batteries 1005, left speaker 1099, and left front microphone 1059 and left rear microphone 1061. The nine interconnect terminals on the right side 103 are labeled 1089 through 1097 and the nine interconnect terminals on the left side 105 are labeled 1033 through 1041. Terminal 1089 is connected to terminal 1033 via a wire which crosses over from right to left through the headband 108. Similarly wires across connect 1090 to 1034, 1091 to 1035, 1092 to 1036, 1093 to 1037, 1094 to 1038, 1095 to 1039, 1096 to 1040, and 1097 to 1041. The table below lists the function of each right-left interconnect terminal pair.

TABLE 2

| right terminal | left terminal | Function |
|---|---|---|
| 1089 | 1033 | LEFT UP volume pushbutton |
| 1090 | 1034 | LEFT DOWN volume pushbutton |
| 1091 | 1035 | battery negative |
| 1092 | 1036 | battery positive |
| 1093 | 1037 | left front microphone high |
| 1094 | 1038 | left rear microphone high |
| 1095 | 1039 | left microphones low |
| 1096 | 1040 | left speaker low |
| 1097 | 1041 | left speaker high |

With reference to FIG. 7A, this embodiment utilizes digital signal processors 1001 and 1080. The right side electronics of the listening device 102 comprises an embedded microcontroller 1000 which is powered via the battery negative and battery positive connections, BAT− and BAT+. Batteries

1005, for example two AAA batteries connected in series, are located in the left side. A wire interconnecting terminals 1092 and 1036 brings BAT+ across from left to right and a wire interconnecting terminals 1091 and 1035 brings BAT− across from left to right. The BAT− potential is circuit ground. Microcontroller PWR pin 1050 is connected to BAT+ and microcontroller GND pin 1052 is connected to circuit ground. Embedded microcontroller 1000 preferably comprises program memory, non-volatile data memory, digital input/output lines, timing and counting elements, an integrated oscillator to supply the clock signal for microcontroller operation, two analog voltage comparators, a programmable voltage reference, and other features which will be described below. An example of a microcontroller suitable for this embodiment is the PIC18LF4520 supplied by Microchip Technology Inc., Chandler, Ariz.

In the embodiment illustrated in FIG. 7A, both digital signal processors 1001 and 1080 are identical and both are based upon the Gennum GB3215 design (FIG. 6). The Gennum 3215 is a portion of digital signal processor 1001 and a second Gennum 3215 is a portion of digital signal processor 1080. A more detailed description of the digital signal processors is found below with reference to FIG. 8. The output circuitry of the digital signal processors in this embodiment is an over-sampled digital to analog converter with a switched mode power amplifier. Thus the signals at the output pins are digital rather than analog signals.

Right side pushbuttons 1045, 1047, 1048 and 1049 connect directly to microcontroller inputs at pins 1058, 1060, 1067 and 1063, respectively. Pushbutton 1045 may provide the right-side volume up function and pushbutton 1047 may provide the right-side volume down function. Pushbuttons 1048 and 1049 may provide various setting selection functions. In an embodiment, pushbutton 1048 selects one of a plurality of frequency response characteristics and pushbutton 1049 selects one of a plurality of directionality characteristics. Other setting choices may be available depending upon particular requirements for the assisted listening application.

Left-side pushbuttons, shown as 1006 and 1007 on FIG. 7B, are connected to microcontroller 1000 at pins 1055 and 1057, respectively. Left pushbutton 1006 may provide the left-side volume up function and left pushbutton 1007 may provide the left-side volume down function. Microcontroller 1000 controls the right side digital signal processor 1001 via three output lines, 1021, 1023, 1025, and one comparator input line 1032. Microcontroller 1000 similarly controls the left side digital signal processor 1080 via three output lines 1072, 1073, 1074, and one comparator input line 1075. Lines 1021, 1023, 1025, and 1032 connect the microcontroller to right side serial data interface circuit 1031 and lines 1072, 1073, 1074 and 1075 connect the microcontroller to left side serial data interface circuit 1071. Right data interface 1031 communicates with right digital signal processor 1001 via a single bidirectional serial data line (right SDA) 1030. In the same way, left data interface 1071 communicates with the left digital signal processor 1080 via left SDA line 1070.

A source of power for signal processors 1001 and 1080 and to serial data interface circuits 1031 and 1071 is supplied by voltage regulator 1020 which may be, for example, the LT1761ES5-SD supplied by Linear Technology Corporation, Milpitas, Calif. Voltage regulator 1020 is connected to BAT+ at pin 1022 and its regulated output voltage is at pin 1026. Enable input pin 1024 of voltage regulator 1020 is connected to microcontroller output pin 1054, labeled as PWR_ON. When microcontroller pin 1054 is high, voltage regulator 1020 supplies its output voltage, $V_1$, in this embodiment 1.3V, to both the right and left signal processors at pins 1002 and 1082, respectively and to both the right and left serial data interface circuits at pins 1046 and 1053, respectively. Another source of power to signal processors 1001 and 1080 and to serial data interfaces 1031 and 1071 is BAT+, which is connected to both right and left processors at pins 1004 and 1069, respectively, and to both right and left serial data interfaces at 1046 and 1056, respectively. BAT+ provides a higher voltage for components and circuitry which cannot function with a lower supply voltage of $V_1$. Right and left signal processors are connected to circuit ground at pins 1003 and 1084 respectively.

Because the OUT signals at terminals 1010 and 1011 (right side) and terminals 1088 and 1068 (left side) drive the headphone speakers directly, the output amplifiers in the signal processors require the higher voltage $V_B$. The digital signal processor output stages are placed into a low power state when their ENAB terminals, 1083 and 1085 respectively, are held at a logic high level. When the ENAB terminals are held high, the OUT terminals 1010, 1011, 1088 and 1068 are all in a high impedance state, preventing current through either right speaker 1014 or left speaker 1099. An output pin 1029 of microcontroller 1000 provides the OUT_ON logic signal which is connected to both digital signal processors at their ENAB terminals 1083 and 1085. Further details regarding power sources for digital signal processors 1001 and 1080 are discussed in reference to FIG. 8 below.

In the embodiment of FIGS. 7A and 7B, right digital signal processor 1001 is connected to two microphones, a right front microphone 1012 and a right rear microphone 1013. Similarly left digital signal processor 1080 is connected to a left front microphone 1059 and a left rear microphone 1061, both shown in FIG. 7B. Digital signal processors 1001 and 1080 are capable of processing the front and rear microphone signals in such a way as to enhance directionality, a feature not uncommon in modern digital signal processing components utilized in hearing instruments. Right digital signal processor 1001 is connected to right speaker 1014 and left digital signal processor is connected to left speaker 1099.

Microphones 1012, 1013, 1059 and 1061 may be omnidirectional two-terminal electret microphones having a diameter of 6 millimeters, and speakers 1014 and 1099 may be 32 ohm headphone speakers having a diameter of 50 millimeters. The low terminal of right front microphone 1012 is connected to the IN1− pin 1027 of the right signal processor 1001 and the low terminal of the right rear microphone 1013 is connected to the IN2− pin 1028. The high terminal of right front microphone 1012 is wired both to the IN1+ pin 1008 of the right digital signal processor and to a power source via resistor 1015, in this embodiment to PWR_ON via a 3.3K ohm resistor. Similarly the high terminal of right rear microphone 1013 is wired both to the IN2+ pin 1009 and to resistor 1017. Right-side digital signal processor OUT+ pin 1010 is wired to the high terminal of right speaker 1014 and the OUT− pin 1011 is wired to the low terminal of right speaker 1014.

Left digital signal processor 1080 is similarly connected to both left front microphone 1059, left rear microphone 1061, and left speaker 1099. The low terminals of both the left front and left rear microphones are connected together and wired across to the right side of the headset via interconnect terminals 1039 (on the left side) and 1095 (on the right side). Right side interconnect terminal 1095 is wired to both the IN1− pin 1076 and the IN2− pin 1077 of the left digital signal processor. The high terminal of left front microphone 1059 is wired both to the IN1+ pin 1086 of the left digital signal processor and to a power source via resistor 1087, in this embodiment to PWR_ON via a 3.3K ohm resistor. Similarly the high terminal of left rear microphone 1061 is wired both to the IN2+ pin 1078 and to resistor 1079. Left-side digital signal processor OUT+ pin 1088 is wired to the high terminal of left speaker 1099 and the OUT− pin 1068 is wired to the low terminal of left speaker 1099.

In this embodiment, the power source for all four microphones is the PWR_ON signal from pin 1054 of microcontroller 1000. This PWR_ON signal is also wired to the enable input 1024 of voltage regulator 1020, as discussed above, $V_2$ pins 1004 and 1069 of the right and left signal processors 1001 and 1080, respectively, and $V_2$ pins 1051 and 1056 of the right and left serial data interface circuits 1031 and 1071 respectively. Thus when PWR_ON is set low, no current is supplied to any of the microphones, to either signal processor, or to either serial data interface circuit. Further, microcontroller 1000, which is always connected to the battery voltage BAT+, may be set to a low power "sleep" state under firmware control. Additionally, when microcontroller output pin 1029 is held high (OUT_ON deasserted), the output state circuitry of digital signal processor 1001 and 1080 draw very little current. Other components which are either connected directly to BAT+ or directly to a microcontroller output pin, with the exception of LED 1066, draw little current. Consequently, when PWR_ON is set low, OUT_ON is set high, LED 1066 is off, and microcontroller 1000 is asleep, a low amount of current is drawn from the batteries.

Output pin 1064 of microcontroller 1000 is connected to LED 1066 though series resistor 1065. LED 1066 glows when the device is on and may be used for other functions. Preferably LED 1066 is a high-efficiency type and resistor 1065 is selected such that the LED glows dimly when the device is turned on to ensure that little battery current is used and any potential disturbance to people who may see the LED in a dimly lit environment is lessened.

The signal at output pin 1018 of microcontroller 1000 may be a modulated logic signal, which, when processed by filter 1019, can provide an auxiliary signal, for example a series of beeps, to right and left digital signal processor AUX input pins 1016 and 1081, respectively. Auxiliary signals are audible to the user of the headset and may provide an alert indicating certain conditions, such as a weak or dead battery. A wide variety of signals, including speech-like signals, may be produced at the output of filter 1019 depending on the modulation characteristics of the signal at pin 1018 of the microcontroller 1000. In the case where the microcontroller 1000 is the PIC18F4520, a pulse-width modulated output (PWM) is available which greatly increases the variety of auxiliary signals which may be produced.

Figure 8:
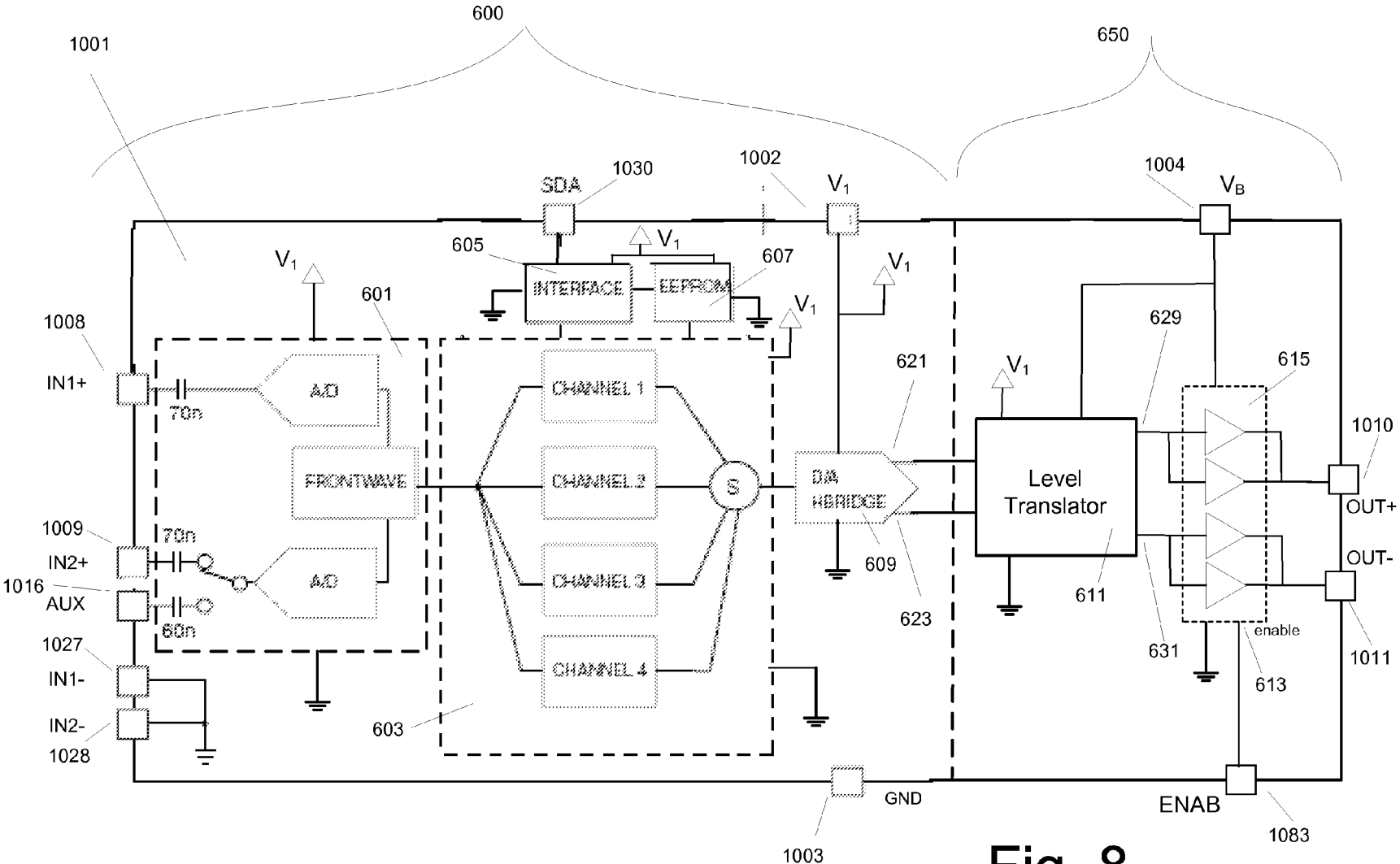
FIG. 8 is a block diagram of a digital signal processor suitable for use in an embodiment.

FIG. 8 is a block diagram of a right-side digital signal processor suitable for use in the embodiment illustrated in FIGS. 7A and 7B. Preferably the left-side signal processor is of the same general design as the right-side processor. In some embodiments, digital signal processor 1001 is based on prior art digital signal processor 502, the Gennum model GB3215 illustrated in FIG. 6. A portion of digital signal processor 1001 is identical to the Gennum GB3215 and is labeled 600. Processor 1001 comprises an output amplifier 650 in addition to prior art circuitry 600.

Digital signal processor 1001 processes signals at its IN1+ terminal 1008, its IN2+ terminal 1009 and its AUX terminal 1016, resulting in an output signal suitable for driving a headphone speaker at its OUT terminals 1010 and 1011. The signals at IN1+ terminal 1008 and IN2+ terminal 1009 are digitized and may be combined by front-end processing block 601 such that when the two signals are derived from two properly placed microphones, directionality is enhanced. Signal processor terminals IN1− 1027 and IN2− 1028, which are internally connected to circuit ground are provided as connection points for the low side of the input sources, for example microphones, which are connected to IN1+ and IN2+ terminals 1008 and 1009. There are two power connections, $V_1$ and $V_B$ at terminals 1002 and 1004 respectively, and circuit ground is connected to GND terminal 1003.

In addition to the front end processing block 601, digital signal processor 1001 comprises core processing block 603, electrically erasable and programmable memory (EEPROM) 607 and a communications interface 605. The operation of core processing block 603, is described in Gennum literature. Communications interface 605 provides bidirectional serial data communications at SDA terminal 1030. All signal processing functions of processor 1001 are accessible through communications at the SDA terminal 1030, including control of the volume, frequency response, directional processing, and compression characteristics.

The output of core processing block 603 is applied to the input of Gennum output stage 609, which is an over-sampled digital to analog converter with a switched mode (H-Bridge) power amplifier. In applications requiring less output power, such as a conventional hearing aid, the output of H-Bridge 609 can be used to drive a speaker (receiver) directly, as shown in FIG. 2. In this embodiment, however, more output drive is required and thus digital signal processing block 1001 further comprises an output stage which amplifies the signals at the output of H-Bridge 609. The two signals 621 and 623 are, in fact, rapidly modulated logic signals as there is no conventional analog power amplifier in processing block 600. Thus output amplifier 650 comprises digital circuitry.

$V_1$, which is 1.3 volts in a preferred embodiment, powers most of the circuitry of digital signal processor 1001. $V_B$, nominally 3 volts in a preferred embodiment, as supplied by two AAA alkaline batteries in series, powers components in the signal processor which require a higher voltage, such as level translator 611 and quad tri-state buffer/driver 615, both of which are part of output stage 650. The higher voltage at $V_B$ as compared with $V_1$ allows the output of digital signal processor 1001 to supply a greater amount of power to the headphone speaker than would be possible were $V_B$ not provided.

Level translator 611 simply converts the logic signals at 621 and 623, which have a maximum level of $V_1$ to signals at 629 and 631 which have a maximum level of $V_B$. An example of an integrated circuit suitable for use as level translator 611 in an embodiment is the model SN74AVC2T45 supplied by Texas Instruments, Inc., Dallas, Tex. The outputs of level translator 611, 629 and 631, are provided as inputs to quad tri-state buffer/driver 615, which provide the drive capability required at OUT terminals 1010 and 1011.

In some embodiments, quad buffer/driver 615 may be one-half of an SN74AC244 integrated circuit, which is available from Texas Instruments, Inc., Dallas, Tex. Two buffer/driver elements of quad buffer/driver 615 are connected in parallel to boost the drive level of signal 629 and supply a signal to OUT+ terminal 1010. Similarly, two buffer/driver elements are connected in parallel to boost the drive level of signal 631, supplying a signal to OUT− terminal 1011. To prevent output stage 650 from drawing any significant current from the battery when signal processor 1001 is powered down, the ENAB terminal 1083 is set high, which places all four of the elements comprising 615 into a high-impedance state.

A further feature of digital signal processor 1001 is the availability of an AUX signal input at terminal 1016. When configured via serial data communication at SDA terminal 1030, the signal at AUX terminal 1016 may be routed through the signal processing circuitry appearing at OUT terminals 1010 and 1011 when desired. The AUX signal may be an alert to notify the user of various conditions, such as a weak battery. Other uses of the AUX signal input 1016 include a telephone coil for assisting with listening while communicating by telephone, or a direct audio input from a device such as a music player or cell phone.

Figure 9:
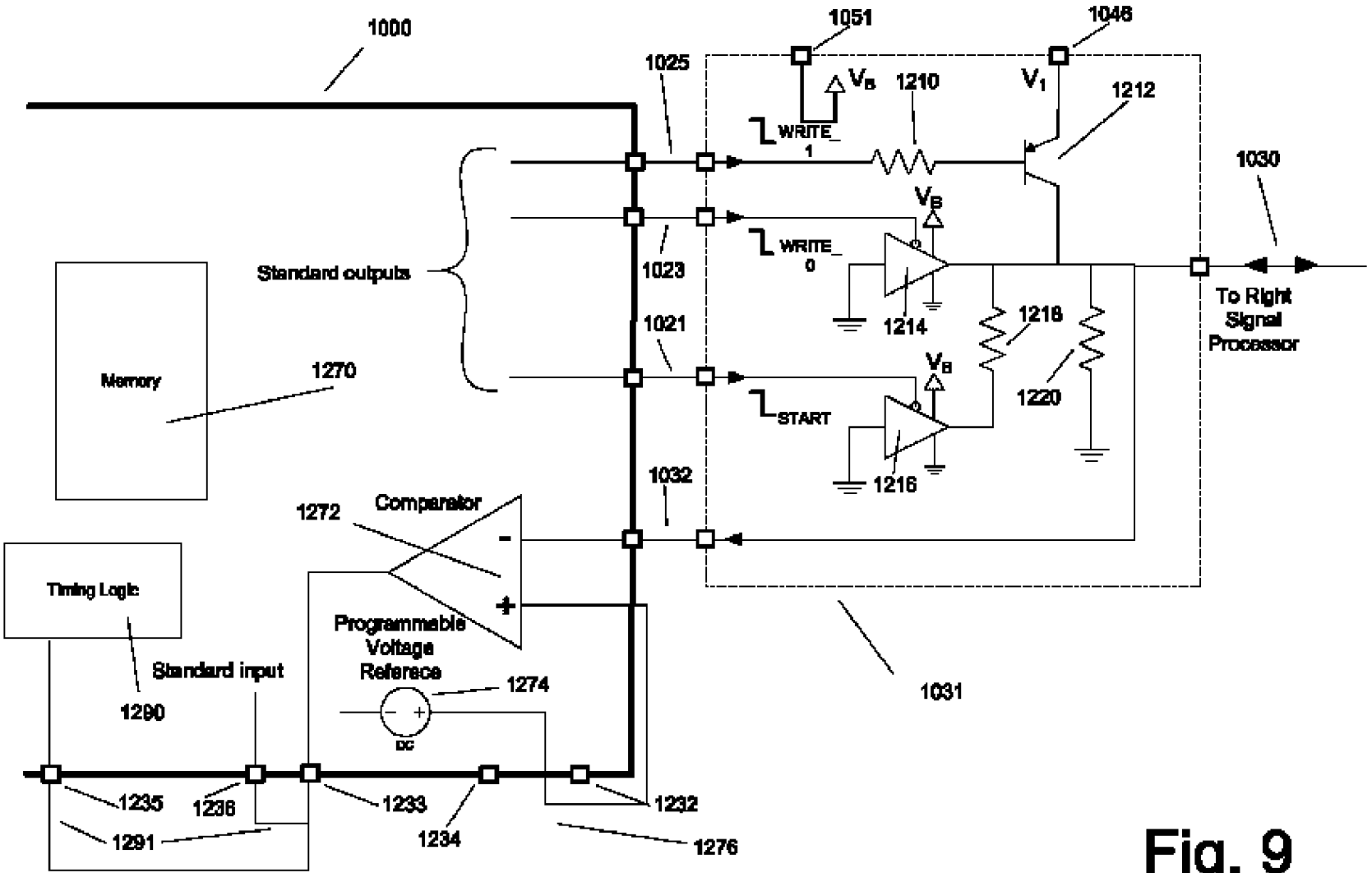
FIG. 9 is a schematic diagram of a serial data interface showing related components of a microcontroller in an embodiment.

FIG. 9 is a schematic diagram of a serial data interface showing related components of a microcontroller in an embodiment. In this case, FIG. 9 details circuitry of right side serial data interface circuit 1031 and portions of microcontroller 1000. The left side serial data interface circuit is identical, although different lines of microcontroller 1000 are utilized for left side communications. In this embodiment, three output lines 1021, 1023 and 1025, and one comparator input line 1035 are connected between the microcontroller 1000 and the right side serial data interface 1031. The same number and type of lines (1072, 1073, 1074, and 1075) are used by the microcontroller to communicate with the left side digital signal processor 1080.

Microcontroller 1000 comprises, inter alia, program memory 1270, timing logic 1290, programmable voltage reference 1274 and analog comparator 1272. These elements may be configured such that 1) the negative (−) input of comparator 1272 is connected to SDA line 1030, 2) the positive (+) input of comparator 1272 is connected to programmable voltage reference 1274 and 3) the output signal of comparator 1272 is connected to both a logic input of microcontroller 1000 and an input to timing logic 1290. This arrangement allows microcontroller 1000 to be programmed such that it can determine the voltage level of SDA line 1030 and can time logic transitions that occur during SDA communication. Further, logic outputs at 1021, 1023 and 1025 operating in conjunction with tri-state gates 1214 and 1216, PNP transistor 1212 and resistors 1210, 1218 and 1220 can control SDA line 1030 in a manner consistent with reliable serial communication from microcontroller 1000 to digital signal processor 1001.

In this embodiment, the signal at SDA line 1030 is routed through right serial data interface 1031 to line 1032, which is the − input of comparator 1272. Microcontroller analog input pin 1232 is configured to be the + input of comparator 1272 and microcontroller analog output pin 1234 is configured to be the output of programmable voltage reference 1274. By connecting pins 1232 and 1234 together via interconnection 1276, the comparator's output will be high when the voltage at SDA line 1030 is below the programmable voltage reference and the comparator's output will be low when the voltage at SDA line 1030 is above the programmable voltage reference. Microcontroller output pin 1233 is configured to be the output of comparator 1272. Connecting pin 1233 both to microcontroller input pin 1236 and to microcontroller timing logic input pin 1235 allows microcontroller 1000 to measure the logic level at the comparator output and to determine (capture) the time of transitions which may occur at the comparator output.

A description of SDA communication with digital signal processor 1001 may be found in Gennum document number 18510 entitled "Paragon™ Digital Serial Interface Specification" and also in "Communication Standard For Programmable Devices, Specification Number 30381-000," published by Starkey Laboratories, Inc., Eden Prairie, Minn. 55344, which are both incorporated herein in their entireties by reference. These documents detail the various possible states of bidirectional SDA line 1030. These states include 1) idle, 2) synchronization, 3) "0" data bit transmission from signal processor, 4) "1" data bit transmission from signal processor, 5) "0" data bit transmission to signal processor and 6) "1" data bit transmission to signal processor.

In order to place the SDA interface into its idle state, the SDA line must not be driven high or low by interface 1031, rather it must be connected to a relatively high-valued resistor 1220, for example 560K ohms. To accomplish this, the signals 1021 (START), 1023 (WRITE_0) and 1025 (WRITE_1) are all deasserted or held in a "1" logic state. The signal 1025, labeled WRITE_1 in FIG. 9, connects to the base of PNP transistor 1212 through base resistor 1210. When signal 1025 is held high, transistor 1212 is off, and when signals 1021 and 1023, labeled START and WRITE_0 in FIG. 9, are held high, tri-state gates 1216 and 1214 are in their high-impedance state, with their outputs having no affect on SDA line 1030. Thus the only load on SDA line 1030 when in its idle state is resistor 1220.

Figure 10:
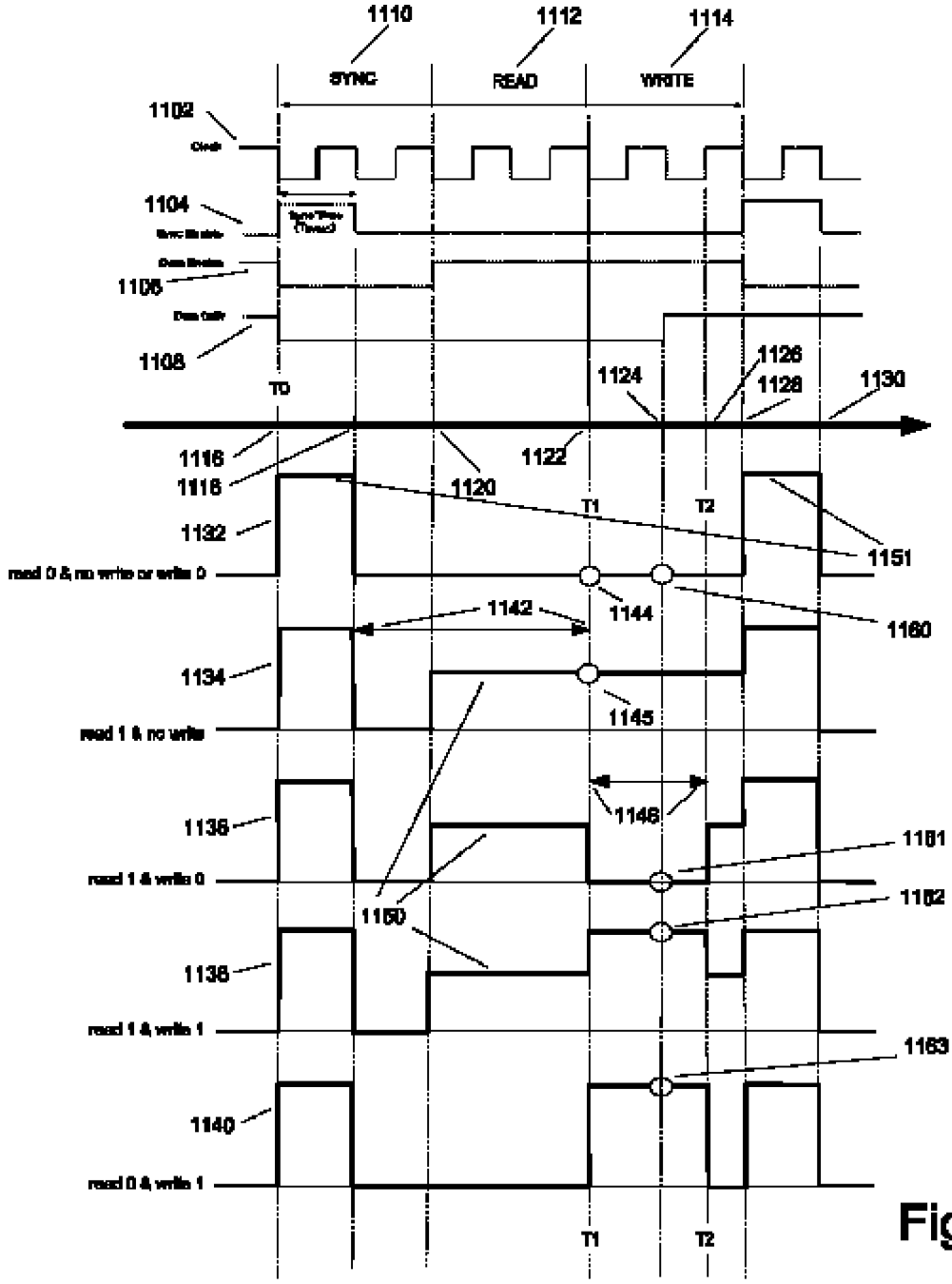
FIG. 10 is a timing diagram of communication with a digital signal processor in an embodiment.

Communication over SDA line 1030 takes place in single "bit-frames" which begin with a synchronization phase and include specific times when data may be transmitted by digital signal processor 1001 and when data may be read by digital signal processor 1001. FIG. 10 illustrates the detail timing of events during each bit-frame. An internal baud clock signal 1102 is generated by the interface block 605 (shown in FIG. 8) of digital processor 1001. Each bit-frame comprises six cycles of baud clock signal 1102, divided equally into three phases, a SYNC phase 1110, spanning from moment 1116 to moment 1120, a READ phase 1112, spanning from moment 1120 to moment 1122, and a WRITE phase 1114, spanning from moment 1122 to moment 1128. Each of the three phases comprises 2 cycles of the baud clock. Other internal timing waveforms, 1104, 1106 and 1108, generated within interface block 605, are illustrated in FIG. 10 and discussed below. Moment 1116, or T0, is the beginning of a bit-frame and moment 1122, or T1, is four baud clock cycles after T0.

To initiate communication over SDA line 1030, the START signal 1021 is set to its low state, enabling gate 1216. When gate 1216 is enabled, resistor 1218 is pulled to ground and in some embodiments, the value of resistor 1218 is 3300 ohms. This load on SDA line 1030 is significantly greater than the load provided by resistor 1220 alone when the SDA line is in its idle state. Interface block 605, shown in FIG. 8, responds to this load change by initiating a sequence of 24 bit-frames. Each bit-frame begins with a synchronization pulse illustrated as waveform 1104, which spans from moment 1116 to moment 1118.

In order to communicate reliably, microcontroller 1000 must determine the time between synchronization pulses, for example, the time between moment 1118, the falling edge of a first synchronization pulse, and moment 1130, the falling edge of a next synchronization pulse. In order to accomplish this, serial data interface 1131 is configured such that timing logic 1290 can capture the time at which moment 1118 occurs and then subsequently capture the time at which moment 1130 occurs. The difference between these two times is the bit-frame duration. Although the bit-frame duration has a nominal predetermined value, based upon the baud rate configuration of signal processor 1001, the bit-frame duration is preferably measured periodically to ensure reliable communication, because the frequency of baud clock signal 1102 may drift due to temperature and other factors.

The 24-bit sequence which takes place when the START signal at pin 1021 goes low is known as the preamble. Preamble data comprises signal processor identification information, baud rate information and other data which may be necessary for a device, such as microcontroller 1000, to properly identify and communicate with the signal processor.

In the illustrated embodiment, when determining bit frame duration, microcontroller 1000 neither reads nor writes data.

During a bit-frame in which data is readfrom digital signal processor 1001, no data is written to it, and, similarly, during a bit frame in which data is written to digital signal processor 1001, no data is readfrom it. This ensures no timing conflicts during communication and simplifies the serial data communication firmware. Throughout each bit-frame, the START line is asserted (signal 1021 low). When the START line is deasserted (signal 1021 high) communication via SDA line 1030 ceases.

The only two possible bit-frame voltage waveforms which take place during the determination of bit-frame duration are illustrated as 1132 and 1134 in FIG. 10. Voltage waveform 1132 corresponds to the case where the digital signal processor is transmitting a "0" bit and voltage waveform 1134 corresponds to the case where the digital signal processor is transmitting a "1" bit. In either case, there are two distinct and measurable synchronization pulse falling edge times, at moments 1118 and 1130, which can be captured by timing logic 1290. The voltage immediately prior to a synchronization pulse falling edge is a voltage level 1151, which is close to $V_1$, 1.3 volt in this embodiment. The voltage immediately following a synchronization pulse falling edge is a level close to ground. Programmable voltage reference 1274 must therefore be set to a level, referred to herein as SYNC_LEVEL, which is less than $V_1$ and greater than 0, for example 1 volt.

A typical bit frame duration is 93.75 microseconds, which corresponds to baud 4. Once the bit frame duration is determined, a moment at which data from signal processor 1001 can be reliably read, for example at 1122 (T1), can be determined, and the moment at which data written to signal processor 1001 is sampled, 1124, can also be determined. During frames in which no data is written to the signal processor, the voltage level which is present on SDA line 1030 remains the same during both the READ period (1120 to 1122) and the WRITE period (1122 to 1128) and that level represents either a "0" or a "1" data bit being sent from the digital signal processor to the device connected to its SDA line.

The time period from moment 1120 to moment 1128 is illustrated by waveform 1106 (internal to interface block 605) and is referred to as the "data enable" period. Voltage waveform 1132 illustrates the reading of a "0" bit and voltage waveform 1134 illustrates the reading of a "1" bit from signal processor 1001. During reading, programmable voltage reference 1274 must be set to a level higher than the "0" bit read level, which is near ground, and lower than the "1" bit read level 1150, which is affected by the value of resistor 1220, and in some embodiments is approximately 0.75 volt. The level at which programmable voltage reference 1274 is set in order to read data from the signal processor is referred to herein as READ_LEVEL, for example, 0.5 volts. Thus, setting the voltage reference 1274 to READ_LEVEL, ensures that the output of comparator 1272, which is connected to an input of microcontroller 1001, reliably reflects either logic "1" or logic "0" on SDA line 1030 when data is being read from the signal processor.

In this embodiment, the points at which data from the signal processor is read for each of two possible voltage waveforms, 1132 and 1134, are labeled 1144 and 1145, respectively. Read points 1144 and 1145 occur approximately at T1. In the case of point 1144, the data read is a "0" and in the case of point 1145, the data read is a "1". Determining the state of SDA line 1030 at read points 1144 and 1145 results in a reliable determination of the data bit being sent from the signal processor. Note that during a bit-frame in which data is read from the signal processor, no data is written to the signal processor. Read points occur approximately 3 baud clock cycles or one half of the bit-frame duration following the falling edge of the synchronization pulse. The read delay (DELAY1) is the duration of time from the falling edge of a synchronization pulse to the moment at which data is read by the microcontroller and is labeled 1142 in FIG. 10. DELAY1 is easy to determine once the bit-frame duration is known.

The digital signal processor samples the SDA line state at the midpoint of the WRITE period, at moment 1124, which is the rising edge of the data shift waveform 1108 (internal to interface block 605) shown in FIG. 10. The SDA line at moment 1124 may be in one of three possible states: 1) the SDA line may be forced to a voltage close to $V_1$, representing writing a "1" data bit to the signal processor, or 2) the SDA line may be forced to a voltage close to circuit ground, representing writing a "0" data bit to the signal processor, or 3) the SDA line may be loaded by a resistor of, for example 20K ohms, a condition interpreted by the signal processor as "no data written." Thus, when writing data to digital processor 1001, either WRITE_1, at 1025, is asserted, or WRITE_0, at 1023, is asserted during a period of time which encompasses the moment 1124. To write a "0" bit to signal processor 1000, SDA line 1030 must be actively pulled low to a voltage close to ground by enabling tri-state gate 1214. Conversely, to write a "1" bit to signal processor 1000, SDA line 1030 must be actively pulled high to a voltage close to $V_1$ by turning on PNP transistor 1212.

Voltage waveforms 1132 and 1136 illustrate microcontroller 1000 writing a data bit "0" and voltage waveforms 1138 and 1140 illustrate microcontroller 1000 writing a data bit "1". Waveforms 1132 and 1140 show bit-frames in which a "0" bit is transmitted from digital signal processor 1001 and waveforms 1136 and 1138 showing bit-frames in which a "1" bit is transmitted from digital signal processor 1001. The points at which data being written to the signal processor is sampled by the signal processor for each of these four possible voltage waveforms, 1132, 1136, 1138 and 1140, are labeled 1160, 1161, 1162 and 1163, respectively. Write points 1160 through 1163 occur at moment 1124, the rising edge of the data shift waveform 1108. In the case of points 1160 and 1161, the data written is a "0" and in the case of points 1162 and 1163, the data written is a "1".

In the illustrated embodiment, the data bit written to digital processor 1001 is first asserted at approximately moment T1 and deasserted at approximately moment T2, 1122 and 1128, respectively. T1 nominally occurs 3 baud clock cycles beyond the falling edge of the synchronization pulse and T2 nominally occurs 4.5 baud clock cycles beyond the falling edge of the synchronization pulse. Thus, deassertion of either WRITE_0 or WRITE_1 occurs approximately 1.5 baud clock cycles (DELAY2) following assertion of either WRITE_0 or WRITE_1. DELAY2 is labeled as 1146 in FIG. 10 and, because it is approximately one-quarter of a bit-frame duration, it is easy to determine once the bit-frame duration is known. In the operation of serial data interface 1031, care must be taken to avoid asserting WRITE_1 and WRITE_0 simultaneously, as this would result in excessive current through transistor 1212 and gate 1214, and serves no purpose.

The communication protocols for digital signal processor 1001 are described in detail in Gennum's document entitled "Paragon™ Digital Serial Interface Specification". A variety of 24-bit commands can be written to digital signal processor 1001 to either alter its configuration or read its configuration. For example, there are commands to change the volume, change the frequency response, change the compression characteristics, adjust the directionality algorithm, change the baud rate, and store or read various characteristics or data from the signal processor's EEPROM memory 607. In some cases, a 24-bit command sent from microcontroller 1000 to signal processor 1001 causes the signal processor to respond by sending back a number of bits to the microcontroller. In other cases, a 24-bit command sent from microcontroller 1000 to signal processor 1001 must be followed by a number of bits of data sent from microcontroller to signal processor.

Figure 11A:
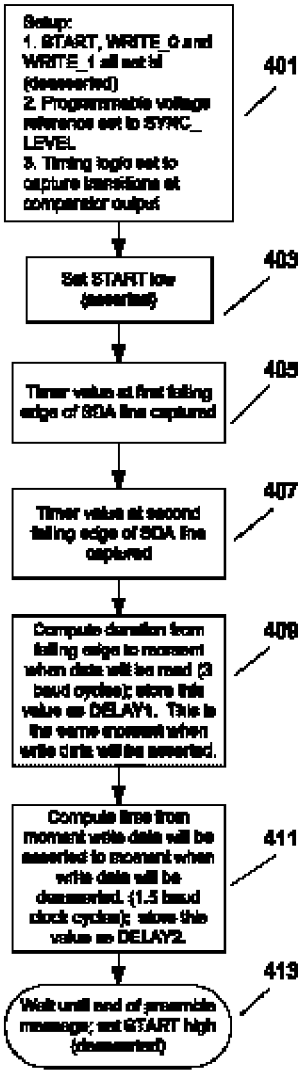
FIG. 11A is a flow chart of steps in an embodiment related to the measurement of frame-bit duration.
Figure 11B:
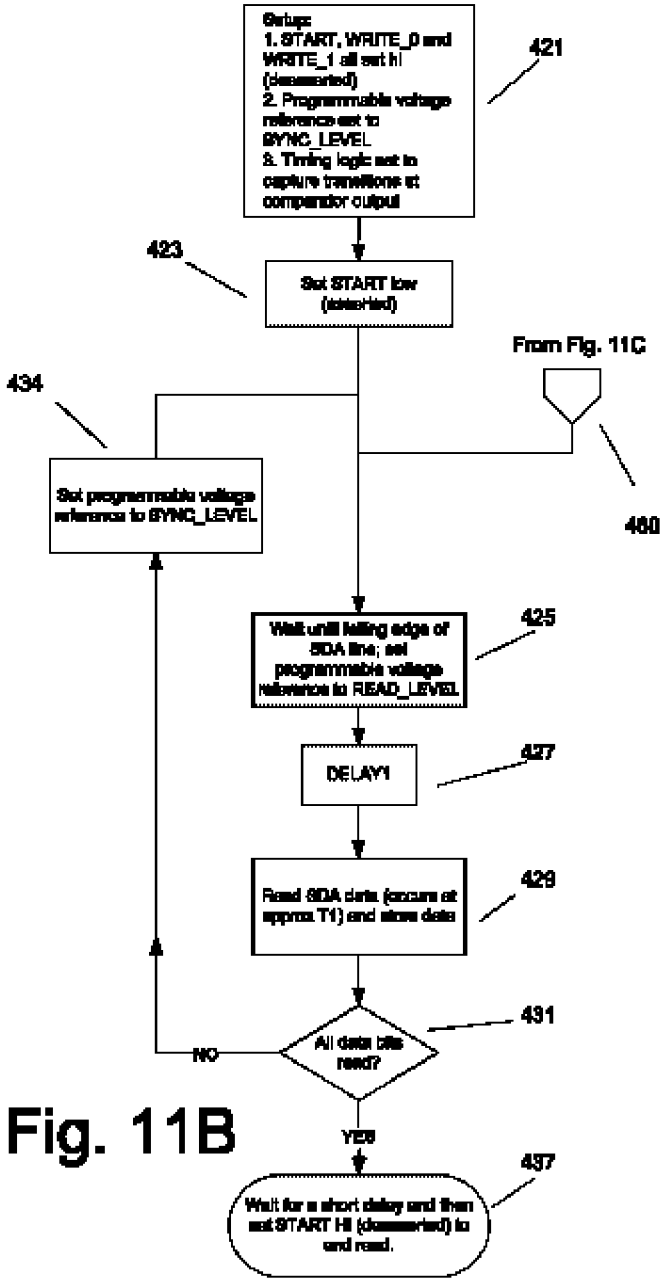
FIG. 11B is a flow chart of steps in an embodiment related to reading data from a digital signal processor.
Figure 11C:
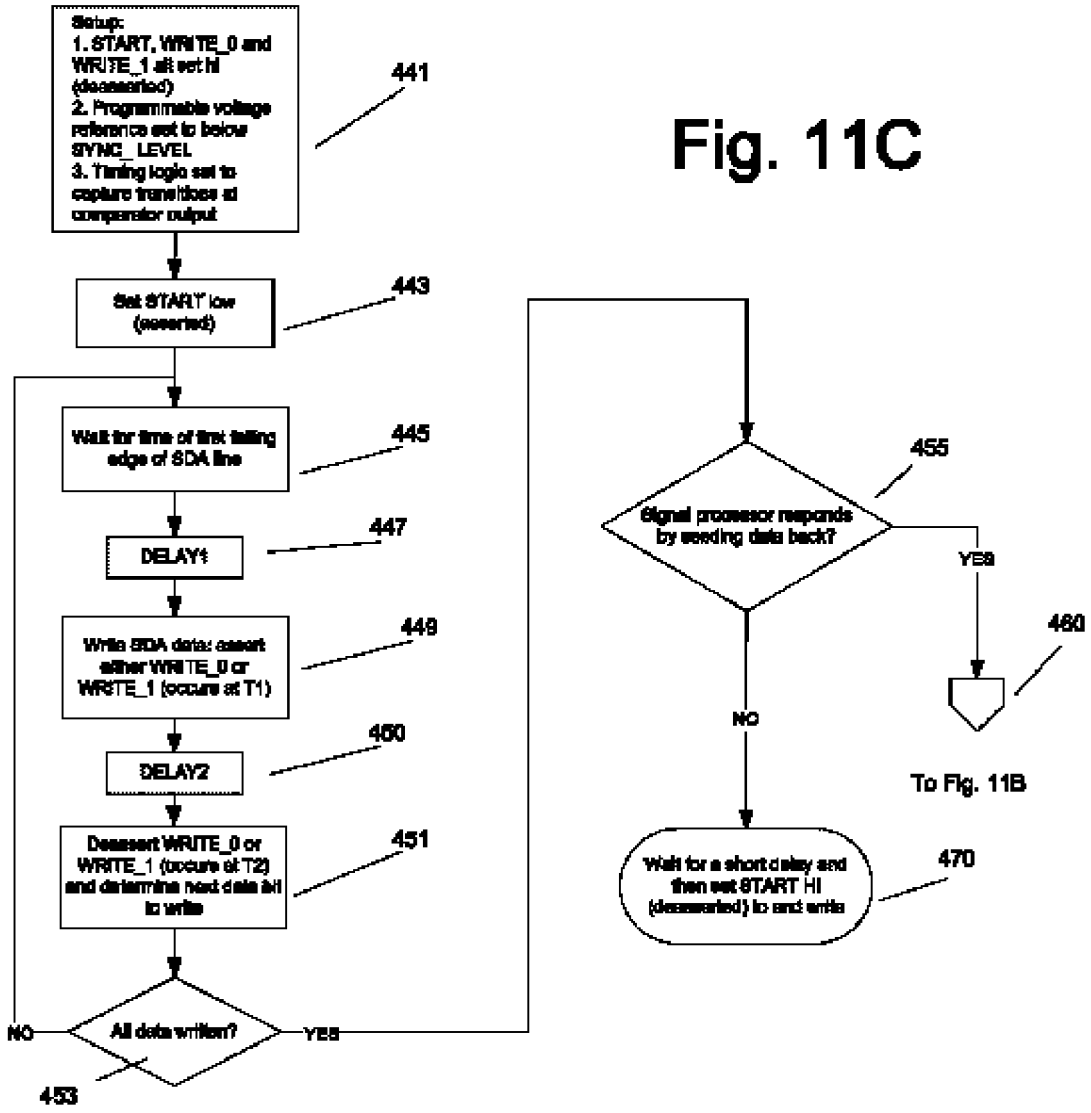
FIG. 11C is a flow chart of steps in an embodiment related to writing data to a digital signal processor.

FIGS. 11A, 11B, and 11C are flow charts related to serial data communication in an embodiment of listening device 102. These figures are applicable to either right-side or left-side communications, however the following discussion assumes that the flow chart relates to the right side signal processor 1001. FIG. 11A is a flow chart of steps in an embodiment related to the measurement of bit-frame duration. At step 401, the microcontroller is set up to measure the bit-frame duration: 1) the START, WRITE_0 and WRITE_1 signals, which occur at microcontroller pins 1021, 1023 and 1025 respectively, are all set high (deasserted), thus resetting the SDA line 1030 into its idle state; 2) programmable voltage reference 1274 is set to SYNC_LEVEL, a level consistent with capturing the falling edge of the synchronization pulses, for example 1 volt; and 3) timing logic 1290 is configured to capture transitions at the output of comparator 1272 which correspond to falling edges of synchronization pulses.

Next, at step 403, the START signal at pin 1021 is asserted. This initiates the transmission of the preamble bits from signal processor 1001 to microcontroller 1000. At step 405, the timer value at the first falling edge of SDA line 1030 is captured. This is moment 1118 of FIG. 10. Then, at step 407, the timer value at the next falling edge of SDA line 1030 is captured and this is moment 1130. The difference in time between moment 1130 and moment 1118 is the bit-frame duration. At step 409, the amount of time represented by 3 baud clock cycles is determined and at step 411, the amount of time represented by 1.5 baud clock cycles is determined. These values are stored as DELAY1 and DELAY2 respectively. DELAY1 is the time between the falling edge of the synchronization pulse to the moment at which either data is read from the signal processor or the moment at which the data to be written to the signal processor is asserted. DELAY2 is the duration of the write pulse when data is written to the signal processor. Finally, at step 413, the microcontroller waits until the end of the 24-bit preamble and then deasserts the START signal. Knowledge of DELAY1 and DELAY2 enables reliable communication with signal processor 1001.

FIG. 11B is a flow chart of steps in an embodiment related to reading data from a digital signal processor. Prior to executing the steps of FIG. 11B, the steps of FIG. 11A have been executed and thus the values DELAY1 and DELAY2, determined at steps 409 and 411 respectively, are known. For the reading of the preamble bits from signal processor 1001, step 421 is executed first. Step 421 is similar to step 401 of FIG. 11A: START, WRITE_0 and WRITE_1 signals are deasserted, programmable voltage reference is set to SYNC_LEVEL and timing logic is configured to capture the times of falling edges of synchronization pulses. Next, at step 423, the START signal at pin 1021 is asserted. This initiates the transmission of the preamble bits from signal processor 1001 to microcontroller 1000. If, however, bits are to be read from signal processor 1001 in response to a command previously sent, then the entry point into the flow chart of FIG. 11B is at 460. Use of entry point 460 is discussed below in reference to FIG. 11C. Note that when the next step 425 is executed, 460, START is asserted, WRITE_0 and WRITE_1 are deasserted, programmable voltage reference 1274 is set to SYNC_LEVEL, and timing logic 1290 is set to capture transitions at the output of comparator 1272, whether or not FIG. 11B was entered at point 460.

A read loop comprising steps 425, 427, and 429 is executed until all bits have been read. In the case where only the preamble bits are to be read, this loop executes a total of 24 times. In cases where data is to be read in response to a command previously sent (FIG. 11B entered at point 460), the loop executes a number of times, depending on the command, for example 64 times. At step 425, the first step of the loop, microcontroller 1000 waits until it detects the falling edge of a synchronization pulse and sets programmable voltage reference 1274 to READ_LEVEL in preparation for reading a data bit from the signal processor. Then, at step 427, the microcontroller delays for a period of DELAY1 or 3 baud clock cycles and, following that delay, at step 429, a data bit is read and stored. Step 429 occurs approximately at moment T1. Following this, at a decision block 431, either the loop repeats or step 437 is executed, depending on whether or not all of the data bits have been read. If all of the data bits have been read, at step 437 there is a short delay to ensure that the final bit-frame has completed and START is deasserted, thus ending the preamble read.

FIG. 11C is a flow chart of steps in an embodiment related to writing data to a digital signal processor. Here, as in the steps described in FIG. 11B, the values DELAY1 and DELAY2 have been previously determined and setup step 441 is identical to setup steps 401 and 421, described previously. At a next step, 443, the START line is asserted. Although 24 bits of preamble data will be sent from signal processor 1001 during the write loop comprising steps 445, 447, 449, 450 and 451, microcontroller 1000 ignores that preamble data and writes 24 command bits, one bit during each of the 24 bit-frames which follow the assertion of the START line. In this embodiment, all commands written to signal processor 1001 are 24 bits in length and all commands are one of three different types. A command either 1) requires no subsequent reading or writing of data, such as, for example, the command to enable the AUX input pin 1016, or 2) causes the signal processor to send data back to microcontroller 1000 in response, such as, for example a read EEPROM memory command or 3) requires that some number of data bits be written following the command itself, such as, for example, a command to change the volume setting or alter the compression characteristics of the signal processor. In each of these three cases, the steps involved differ.

Regardless of the type of command, however, the write loop consisting of steps 445, 447, 449, 450, and 451 is executed at least 24 times. At step 445, microcontroller 1000 waits for the first falling edge of SDA line 1030. Then, after a delay of approximately 3 baud clock cycles (DELAY1) at step 447, write data is asserted at step 449. Either the WRITE_0 signal is asserted or the WRITE_1 signal is asserted, depending on the specific data bit to be sent to the signal processor. The data remains asserted through another delay (DELAY2) at step 450, which is approximately equal to 1.5 baud clock cycles.

As described earlier with respect to FIG. 10, during the assertion of the write bit, signal processor 1001 samples the SDA line to read the bit. Following the delay of step 450, either WRITE_0 or WRITE_1 is deasserted, depending on which had been asserted at step 449, and microcontroller 1000 determines the next data bit to write. Decision block 453 determines whether the write loop repeats. In the case of commands which require no subsequent reading or writing of data, the write loop executes 24 times and control then passes to step 455. In case of commands which cause the signal processor to send back data to the microcontroller in response, the write loop also executes 24 times and control then passes to step 455. However, in cases where the command requires that additional data be sent following the command bits, the write loop, steps 445, 447, 449, 450 and 451, repeats until all bits have been written and only then does control pass to step 455.

At step 455, a decision is made based on whether or not the signal processor will respond by sending data back to the microcontroller in response to the previously sent command. If the microcontroller must read the response to the command, execution continues at entry point 460 of FIG. 11B and the read loop described above is executed repeatedly until all of the response data is read. Otherwise, in cases where no reading of data follows the sending of a command, after a short delay to ensure that the final bit-frame has completed, START is deasserted, thus ending the writing of data at step 470.

Figure 12A:
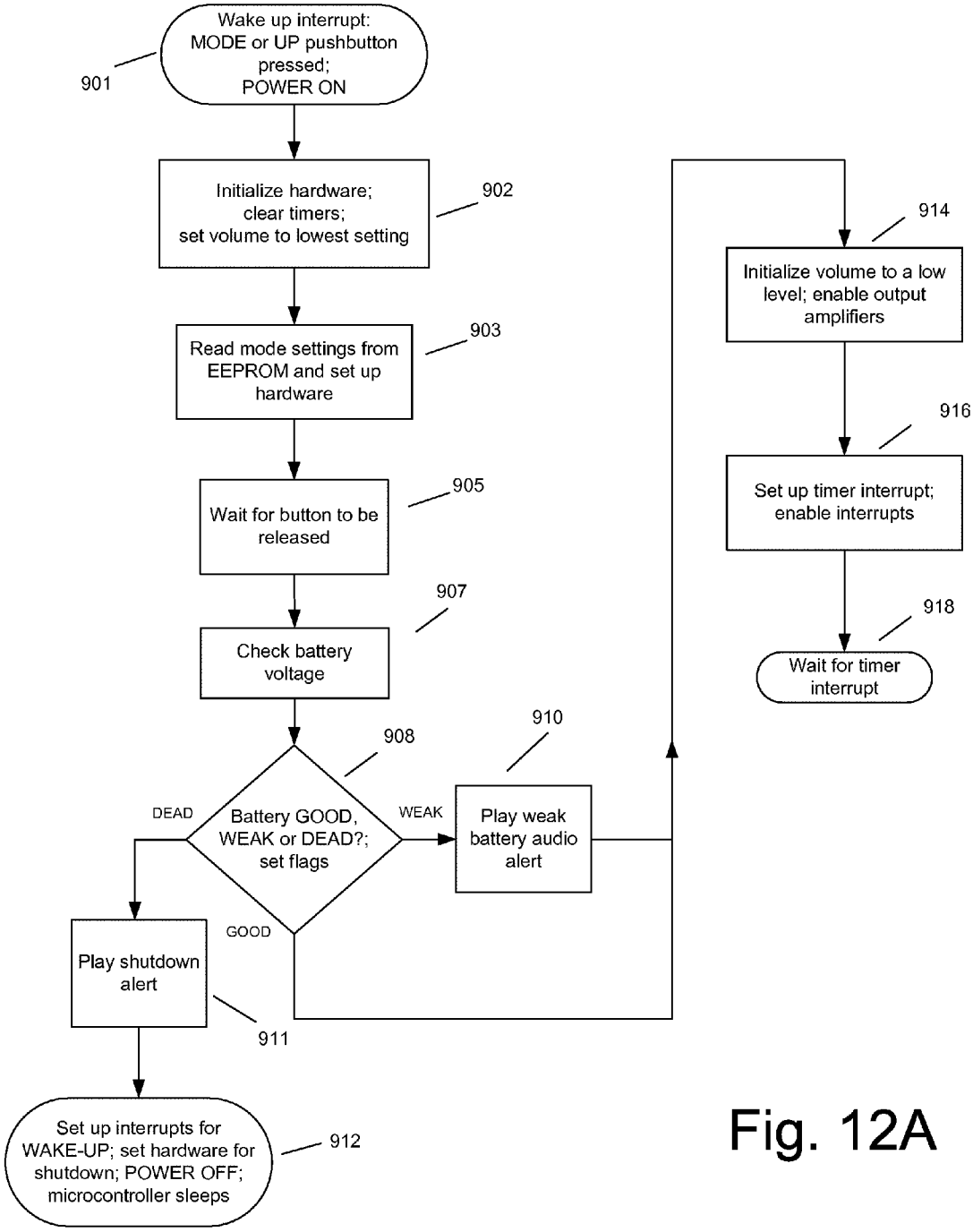
FIG. 12A is a flow chart of the initialization steps in an embodiment.

FIGS. 12A, 12B, 12C and 12D are flow charts illustrating the operation of an embodiment of listening device 102. FIG. 12A is a flow chart of the initialization steps. At step 901, the system responds to an interrupt caused by either a MODE pushbutton, the RIGHT UP pushbutton or the LEFT UP pushbutton. Any one of these pushbuttons creates an interrupt that causes the microcontroller (300 or 1000) to wake up. Note that the microcontroller is always connected to the battery voltage and thus when the listening device 102 turns off, the microcontroller is still powered, although it is operating in a low power "sleep" mode. Immediately upon waking up, hardware is initialized, timers are cleared and volume controls are set to their lowest settings at step 902. At step 903, the previously selected mode, which is stored in EEPROM, is read and that mode is set up by communicating with the signal processors in the listening device 102.

Following a pause at step 905 for the release of the pushbutton which woke up the listening device 102, the battery voltage is checked at step 907. In the embodiments described herein with reference to FIGS. 4 and 7, the microcontroller has the capability of measuring the voltage applied to its PWR pin with sufficient accuracy to determine whether the batteries are GOOD, WEAK, or DEAD. This determination takes place at decision block 908. If the batteries are DEAD, at step 911 a dead battery alert is played through the listening device 102, for example a descending series of beeps, and following this alert the device 102 powers down. Power down in the case of a dead battery occurs at step 912, where first the microcontroller sets up interrupts so that it can be reawakened the next time any one of the MODE, RIGHT UP or LEFT UP pushbuttons is pressed and then it powers down. If the batteries are determined to be WEAK at step 908, a weak battery alert is played through the listening device 102 at step 910, for example a distinctive series of beeps, and if the batteries are GOOD no alert is sounded. Unless the listening device 102 is shut down because of a dead battery, control passes to step 914.

At step 914, the volume of both the right and left signal processors is set to a low default level to ensure that the user does not experience an unduly loud volume setting when the listening device 102 is first turned on. A timer interrupt is set up and enabled at the next step 916. In some embodiments, the timer interrupt occurs once every 32 milliseconds. At step 918, the system waits for the next timer interrupt.

Figure 12B:
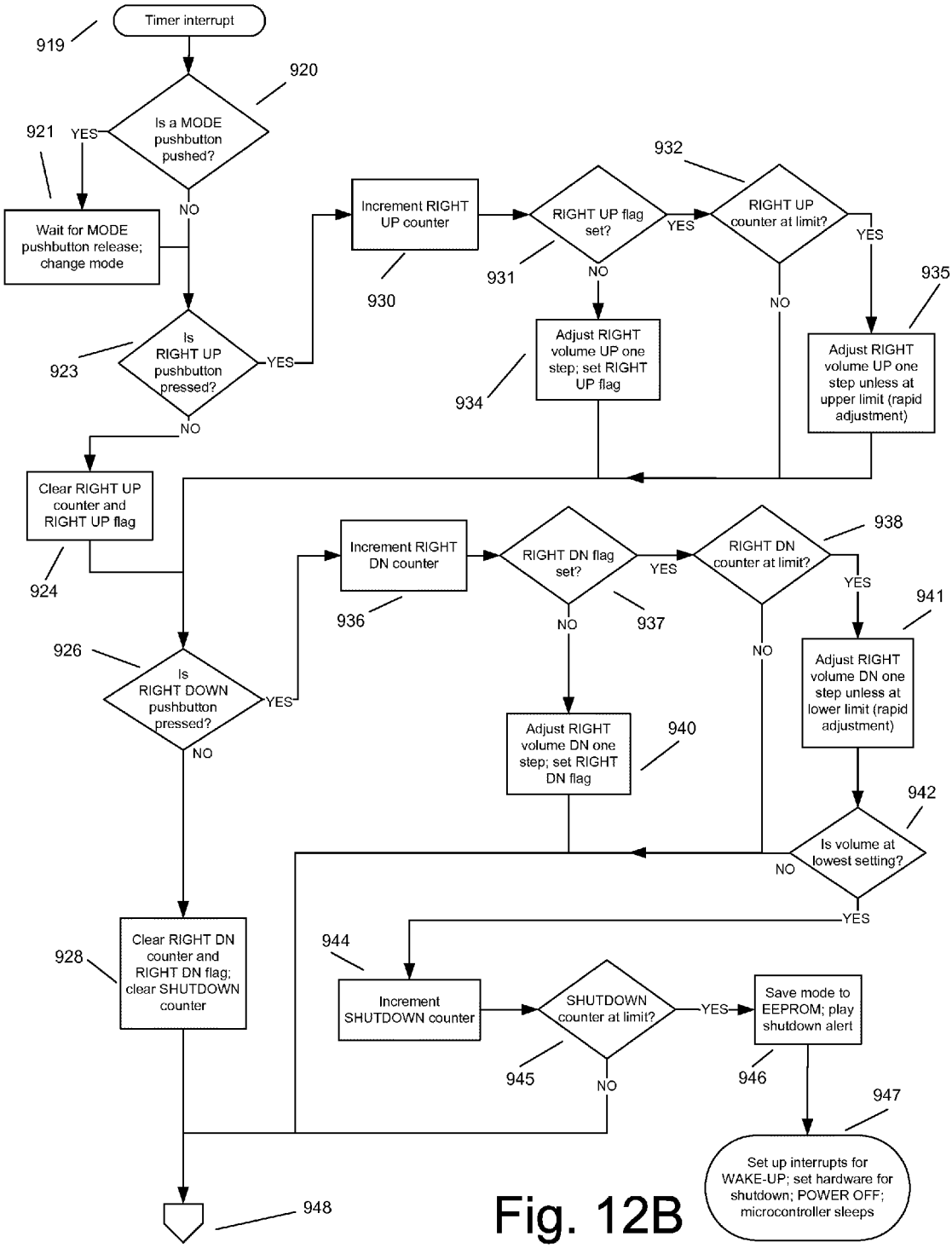
FIG. 12B is a flow chart of steps in an embodiment related to mode setting and adjustment of the right side volume.
Figure 12C:
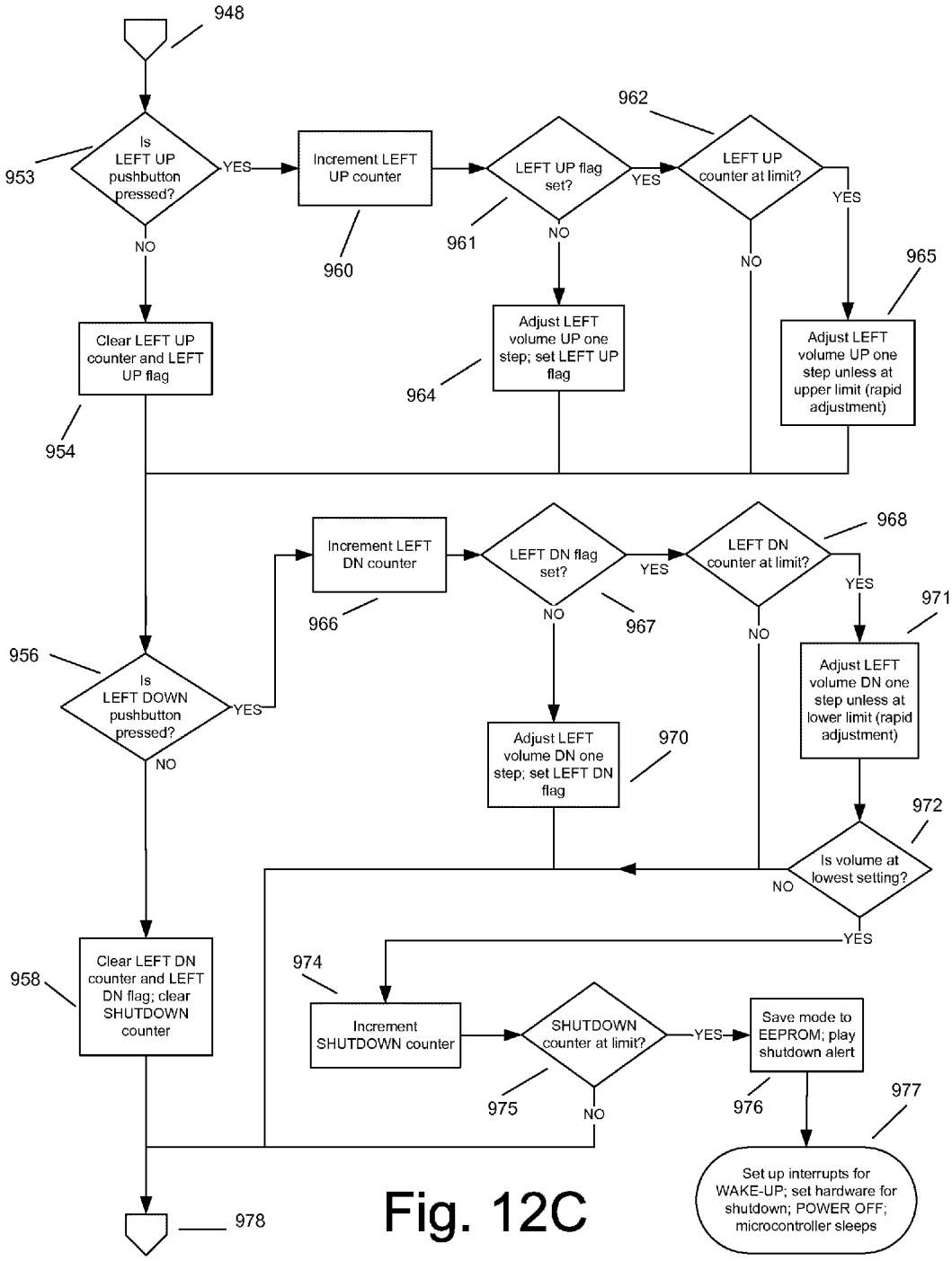
FIG. 12C is a flow chart of steps in an embodiment related to adjustment of the left side volume.
Figure 12D:
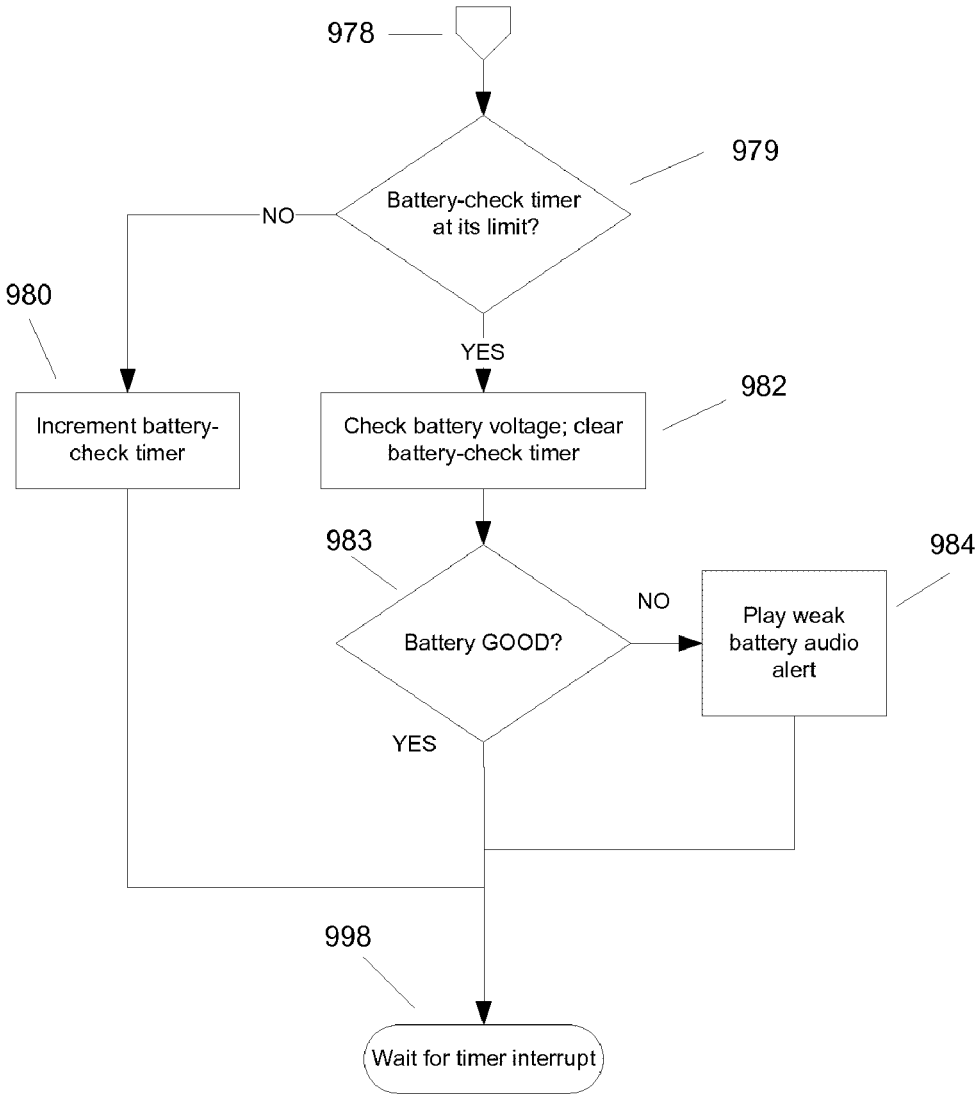
FIG. 12D is a flow chart of steps in an embodiment related to periodic checking of battery status.

In the illustrated embodiment, all handling of pushbutton events, except for the initial turn-on of the listening device 102 shown in FIG. 12A, takes place during the timer interrupt service routine which is detailed in FIGS. 12B, 12C and 12D. A flow chart of steps in an embodiment related to mode setting and adjustment of the right side volume is illustrated in FIG. 12B. Execution of the steps of FIG. 12B begins when a timer interrupt occurs at step 919. The state of each pushbutton is determined in turn, with the MODE pushbuttons being checked first at step 920. FIG. 12B also illustrates the checking of the RIGHT UP pushbutton at step 923 and the checking of the RIGHT DOWN pushbutton at step 926. FIG. 12C illustrates the checking of the LEFT UP pushbutton at step 953 and the checking of the LEFT DOWN pushbutton at step 956.

Referring to FIG. 12B, if a MODE pushbutton is pressed at step 920, the microcontroller waits for its release and then changes mode at step 921. In an embodiment there are at least two modes of operation and the MODE pushbuttons cycle amongst a plurality of modes. Although not shown in FIG. 12B, the microcontroller may respond differently depending on whether the MODE pushbutton was briefly pressed and released or pressed and held for a time and then released. In another embodiment, pressing the MODE button for longer than one second will cause subsequent presses to select other modes not available if the pushbutton is only briefly pressed and released. In yet another embodiment, there are multiple-position selector switches instead of or in addition to at least one MODE pushbutton.

Following the handling of the MODE pushbutton, control passes to step 923 at which point the state of the RIGHT UP pushbutton is determined. The RIGHT UP pushbutton, if briefly pressed simply increments the right volume control setting. However, if the RIGHT UP pushbutton is pressed and held, the right volume control setting will rapidly step up, one step for every timer interrupt which occurs while the pushbutton remains pressed. Steps 930, 931 and 934 execute sequentially when the RIGHT UP pushbutton is first pressed. A RIGHT UP counter is incremented at step 930, and at step 931 a RIGHT UP flag is tested. The RIGHT UP flag informs the microcontroller that the RIGHT UP pushbutton had been previously pressed and has not yet been released. During the first interrupt which occurs after the RIGHT UP pushbutton is pressed, the RIGHT UP flag is clear, so control then passes to step 934 at which point the right volume control is incremented one step and the RIGHT UP flag is set. When the next timer interrupt occurs, provided the RIGHT UP pushbutton has not yet been released, control will pass from step 923 to step 930 to step 931 and then to step 932. At step 932 the RIGHT UP counter is tested to see if it is at its limit. The purpose of the RIGHT UP counter is to measure the amount of time during which the RIGHT UP pushbutton has remained pressed. If the RIGHT UP counter is not yet at its limit, the right volume is not changed; however if the RIGHT UP counter is at its limit, which, for example may be 31, corresponding to 32 interrupts or about 1 second of elapsed time, the right volume control is again incremented one step at 935. Assuming that the pushbutton has still not been released at the time of the next interrupt, the right volume increments again at step 935. Thus if the RIGHT UP pushbutton is pressed and held for over one second, the right volume will increment rapidly, one step every 32 milliseconds. When the RIGHT pushbutton is released, both the RIGHT UP counter and the RIGHT UP flags are cleared at step 924.

Following the steps which handle the RIGHT UP pushbutton, the state of the RIGHT DOWN pushbutton is determined at step 926. Operation of the RIGHT DOWN pushbutton is similar to operation of the RIGHT UP pushbutton, however if the RIGHT DOWN pushbutton is pressed and held until the volume decreases to its lowest setting and then remains held for another predetermined amount of time, the headset will power down. Steps 936, 937 and 940 execute sequentially when the RIGHT DOWN pushbutton is first pressed. If at step 926 the RIGHT DOWN pushbutton is pressed, a RIGHT DOWN counter is incremented at step 936, and at step 937 a RIGHT DOWN flag is tested. The RIGHT DOWN flag informs the microcontroller that the RIGHT DOWN pushbutton had been previously pressed and has not yet been released. During the first interrupt which occurs after the RIGHT DOWN pushbutton is pressed, the RIGHT DOWN flag is clear, so control then passes to step 940 at which point the right volume control is decremented one step and the RIGHT DOWN flag is set. Then when the next timer interrupt occurs, provided the RIGHT DOWN pushbutton has not yet been released, control will pass from step 926 to step 936 to step 937 and then to step 938. At step 938 the RIGHT DOWN counter is tested to see if it is at its limit. If the RIGHT DOWN counter is not yet at its limit, the right volume is not changed; however if the RIGHT DOWN counter is at its limit, the right volume control is again decremented one step at 941. Assuming that the pushbutton has still not been released at the time of the next interrupt, the right volume decrements again at step 935. Thus if the RIGHT DOWN pushbutton is pressed and held for over one second, the right volume will decrement rapidly, one step every 32 milliseconds. When the RIGHT pushbutton is released, both the RIGHT DOWN counter and the RIGHT DOWN flags are cleared at step 928.

If the RIGHT DOWN pushbutton has been pressed and held long enough to rapidly decrease the right volume to its lower limit, then steps 944 and 945 are executed. At step 944, a SHUTDOWN counter is incremented. The purpose of the SHUTDOWN counter is to measure the amount of time during which the RIGHT DOWN pushbutton has remained pressed while the right volume is at its lowest setting. If the SHUTDOWN counter is determined to be at its limit, at decision block 945, the headset will power down. In an embodiment, the SHUTDOWN counter limit corresponds to one second of elapsed time; thus, if the RIGHT DOWN pushbutton has been pressed and held long enough that the right volume has remained at its lowest setting for a second, the headset will power down. Before the headset powers down, at step 946, the present mode will be saved to EEPROM memory and a shutdown alert, for example a distinctive tone, will be played. Then at step 947 the headset powers down after setting up its interrupts so that it can be reawakened the next time any one of the MODE, RIGHT UP or LEFT UP pushbuttons is pressed.

Provided that operation of the RIGHT DOWN pushbutton does not result in the headset powering down, control passes to FIG. 12C at 948. FIG. 12C is a flow chart of steps in an embodiment related to adjustment of the left side volume. The steps illustrated in FIG. 12C are identical to corresponding steps in FIG. 12B; however FIG. 12B deals with the RIGHT UP and RIGHT DOWN pushbuttons, while FIG. 12C deals with the LEFT UP and LEFT DOWN pushbuttons. The state of the LEFT UP pushbutton is determined at step 953. A LEFT UP counter and a LEFT UP flag are involved in the control of left volume in steps 960, 961, 962, 964 and 965, in a manner similar to the involvement of a RIGHT UP counter and a RIGHT UP flag in the control of right volume in corresponding steps 930, 931, 932, 934 and 935. Both the LEFT UP counter and LEFT UP flag are cleared at step 954 when the LEFT UP pushbutton is released.

The state of the LEFT DOWN pushbutton is determined at step 956. A LEFT DOWN counter and a LEFT DOWN flag are involved in the control of left volume in steps 966, 967, 968, 970 and 971, in a manner similar to the involvement of a RIGHT DOWN counter and a RIGHT DOWN flag in the control of right volume in corresponding steps 936, 937, 938, 940 and 941. Both the LEFT DOWN counter and LEFT DOWN flag are cleared at step 958 when the LEFT UP pushbutton is released. Similar to the RIGHT DOWN pushbutton, if the LEFT DOWN pushbutton has been pressed and held long enough to rapidly decrease the left volume to its lower limit, then steps 974 and 975 are executed. At step 974, a SHUTDOWN counter is incremented. The purpose of the SHUTDOWN counter is to measure the amount of time during which the LEFT DOWN pushbutton has remained pressed while the left volume is at its lowest setting. If the SHUTDOWN counter is determined to be at its limit, at decision block 975, the headset will power down. If the LEFT DOWN pushbutton has been pressed and held long enough that the left volume has remained at its lowest setting for a second, the headset will power down. Before the headset powers down, at step 976, the present mode will be saved to EEPROM memory and a shutdown alert will be played. Then at step 977 the headset powers down after setting up its interrupts so that it can be reawakened the next time any one of the MODE, RIGHT UP or LEFT UP pushbuttons is pressed.

Provided that operation of the LEFT DOWN pushbutton does not result in the headset powering down, control passes to FIG. 12D at 978. FIG. 12D is a flow chart of steps in an embodiment related to periodic checking of battery status and sensing of whether or not the device is on the user's head. Following the steps involved with all of the pushbuttons, at step 979 a battery-check timer is compared to a time limit, for example, 10 minutes. If the timer is at the battery check time limit, the timer is cleared and the battery voltage is checked at step 982 in a manner similar to how it was checked when the headset first turned on at step 907. If, however, the battery-check timer is not at its limit, the timer is incremented at step 980 and control passes to step 986. At step 983, which is executed once every 10 minutes in an embodiment, the batteries are determined to be either GOOD or NOT GOOD. If the batteries are NOT GOOD a weak battery audio alert is played at step 984 before control moves on to step 986. Because in a preferred embodiment there are at least several hours of battery life left following the initial determination that a battery is WEAK, the inventors have found it unnecessary to distinguish between WEAK and DEAD while the headset is operating. If the batteries are DEAD, the headset will not turn on (see steps 908, 911 and 912 of FIG. 12A) and if the batteries are weak, the user will be reminded every 10 minutes. If the batteries are determined to be GOOD at step 983, control passes to step 998 and the system waits for the next timer interrupt to occur. When the next timer interrupt occurs the steps illustrated in FIGS. 12B, 12C and 12D repeat.

Embodiments of the listening device 102 may be realized with analog signal processing technology, digital signal processing technology or a combination of the two. Forms of signal processing other than those described in any particular embodiment herein may be employed. Suitable analog signal processors, for example, include those described in U.S. Pat. No. 5,553,151 to Goldberg and U.S. Pat. No. 5,131,046 to Killion. In addition, the listening device 102 may be realized in a variety of forms, such as, for example, a circumaural headset, an on-the-ear headset, or a device which fits in the ear yet does not involve a custom earmold. Further, other combinations of hardware and software may be employed in carrying out the listening device 102 in accordance with the scope of the appended claims.

Although this invention has been described in terms of certain preferred embodiments, other embodiments that are apparent to those of ordinary skill in the art, including embodiments that do not provide all of the features and advantages set forth herein, are also within the scope of this application. Rather, the scope of the present invention is defined only by reference to the appended claims and equivalents thereof.

What is claimed is:

1. A headworn assistive listening device comprising:

an input transducer configured to receive acoustic input signals;

a signal processor operatively connected to the input transducer being configured to process input signals from the input transducer and having programmable signal processing characteristics;

a right ear assembly in communication with the signal processor and having a first output transducer configured to generate audible audio output signals based on the processed input signals;

a left ear assembly in communication with the right ear assembly and having a second output transducer configured to generate audible audio output signals based on the processed input signals;

a headband interconnecting the right ear assembly and the left ear assembly;

a memory configured to store a plurality of user-selectable signal processing settings, including frequency response and compression characteristics;

a user-operable control configured to enable a user to select a desired signal processing setting; and a microcontroller operatively connected to the signal processor, the memory and the user-operable control, the microcontroller being configured to select a signal processing setting based on an input received via the user-operable control, wherein the headworn assistive listening device is configured such that hearing loss of the user is ameliorated.

2. The headworn assistive listening device of claim 1, wherein the signal processor comprises an analog signal processor.

3. The headworn assistive listening device of claim 1, wherein the signal processor comprises a digital signal processor.

4. The headworn assistive listening device of claim 1, wherein the input transducer comprises a microphone.

5. The headworn assistive listening device of claim 1, wherein the input transducer comprises an infrasonic transducer and the signal processor is configured to process infrasonic information such that it may be heard.

6. The headworn assistive listening device of claim 1, wherein the input transducer comprises an ultrasonic transducer and the signal processor is configured to process ultrasonic information such that it may be heard.

7. The headworn assistive listening device of claim 1, further comprising a Bluetooth receiver, an infrared receiver or a radio frequency receiver for receiving an auxiliary input signal.

8. The headworn assistive listening device of claim 1, further comprising an input connector for receiving an audio input signal from an external device.

9. The headworn assistive listening device of claim 1, wherein the operation of the listening device is compliant with Specification Number 30381-000 of the Communication Standard For Programmable Devices.

10. A method for operating a headworn listening device comprising a right earphone assembly and a left earphone assembly interconnected by a headband, the method comprising:

placing the right earphone assembly on or in a user's right ear;

placing the left earphone assembly on or in the user's left ear, the left earphone assembly in communication with the right earphone assembly via the headband; and adjusting the performance of both the right and left earphone assemblies by actuating a user-operable control coupled to a microcontroller to select a signal processing setting from among a plurality of such settings stored in memory, wherein each signal processing setting comprises a collection of individual signal processing characteristics, including frequency response and compression characteristics, and wherein the user-operable control is configured such that, when actuated, the selected collection of individual signal processing characteristics are adjusted simultaneously.

11. The method of claim 10, wherein the headworn listening device comprises a plurality of microphones and circuitry for combining output signals from the plurality of microphones to provide directional response characteristics.

12. The method of claim 10, wherein the user-operable control comprises a switch or pushbutton.

13. The method of claim 10, wherein the user-operable control is configured, when actuated, to turn on the listening device at a safe volume level.

14. The method of claim 10, wherein the plurality of signal processing settings stored in memory comprises a first setting configured for a quiet environment and a second setting configured for a noisy environment.

15. A headworn listening device comprising:

means for receiving acoustic input signals;

means for processing the received acoustic input signals and providing processed received acoustic input signals which are a substantially instantaneous reproduction of the acoustic input signal;

a right ear assembly and a left ear assembly interconnected by a headband, each ear assembly having an output transducer configured to generate audible audio output signals based on the processed received acoustic input signals; and means for configuring the processing characteristics of the headworn listening device by selecting from among a plurality of predetermined processing settings stored in a memory under the control of a microcontroller in communication with at least one user-operable control, the predetermined processing settings including frequency response and compression characteristics, wherein the headworn assistive listening device is configured to continuously generate audible audio output signals based on the received acoustic input signals.

16. The headworn listening device of claim 15, wherein the headband is configured to be worn on the user's head.

17. The headworn listening device of claim 15, wherein the headband is configured to wrap behind the user's neck or hang under the user's chin.

18. The headworn listening device of claim 15, wherein the right ear assembly and the left ear assembly comprise circumaural earphones.

19. The headworn listening device of claim 15, wherein the right ear assembly and the left ear assembly comprise earbuds, supra-aural earphones, canalphones, or in-ear monitors.

20. The headworn listening device of claim 15, wherein the input transducer comprises an infrasonic transducer and the signal processor is configured to process infrasonic information such that it may be heard.

21. The headworn listening device of claim 15, wherein the input transducer comprises an ultrasonic transducer and the signal processor is configured to process ultrasonic information such that it may be heard.

22. The headworn listening device of claim 15, wherein the signal processor is configured to process the received acoustic input signals such that the processed received acoustic input signals are output from the signal processor to the left and right ear assemblies in about 2 milliseconds or less after the input transducer receives the acoustic input signals.

* * * * *